US007967923B2

(12) United States Patent
Furuya et al.

(10) Patent No.: US 7,967,923 B2
(45) Date of Patent: Jun. 28, 2011

(54) STEEL PLATE THAT EXHIBITS EXCELLENT LOW-TEMPERATURE TOUGHNESS IN A BASE MATERIAL AND WELD HEAT-AFFECTED ZONE AND HAS SMALL STRENGTH ANISOTROPY, AND MANUFACTURING METHOD THEREOF

(75) Inventors: Hitoshi Furuya, Tokyo (JP); Naoki Saitoh, Tokyo (JP); Motohiro Okushima, Tokyo (JP); Yasunori Takahashi, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/989,330

(22) PCT Filed: Oct. 1, 2009

(86) PCT No.: PCT/JP2009/005084

§ 371 (c)(1),
(2), (4) Date: Oct. 22, 2010

(87) PCT Pub. No.: WO2010/038470

PCT Pub. Date: Apr. 8, 2010

(65) Prior Publication Data

US 2011/0036469 A1 Feb. 17, 2011

(30) Foreign Application Priority Data

Oct. 1, 2008 (JP) ..... 2008-256122
Jan. 5, 2009 (JP) ..... 2009-000202

(51) Int. Cl.
*C22C 38/44* (2006.01)
*C22C 38/46* (2006.01)
*C21D 8/02* (2006.01)

(52) U.S. Cl. ..... 148/335; 148/336; 148/653; 148/654

(58) Field of Classification Search ..... 148/335, 148/336, 654, 653; 420/109, 119
See application file for complete search history.

(56) References Cited

U.S. PATENT DOCUMENTS 4,826,543 A 5/1989 Yano et al.
4,946,516 A 8/1990 Yano et al.

FOREIGN PATENT DOCUMENTS

JP 356033425 * 4/1981

(Continued)

OTHER PUBLICATIONS

International Search Report for PCT/JP2009/005084 mailed Dec. 15, 2009.

*Primary Examiner* — Deborah Yee
(74) *Attorney, Agent, or Firm* — Birch, Stewart, Kolasch & Birch, LLP

(57) ABSTRACT

The present invention provides a steel plate that exhibits excellent low-temperature toughness in a base material and a weld heat-affected zone and has small strength anisotropy, wherein the steel includes, by mass, C: 0.04%-0.10%; Si: 0.02%-0.40%; Mn: 0.5%-1.0%; P: 0.0010%-0.0100%; S: 0.0001%-0.0050%; Ni: 2.0%-4.5%; Cr: 0.1%-1.0%; Mo: 0.1%-0.6%; V: 0.005%-0.1%; Al: 0.01%-0.08%; and N: 0.0001%-0.0070%, with the balance including Fe and inevitable impurities, a Ni segregation ratio at a portion located at one-fourth of a thickness of the steel plate in a steel-plate thickness direction from a surface of the steel plate is 1.3 or lower, a degree of flatness of a prior austenite grain is in a range from 1.05 to 3.0, an effective diameter of crystal grain is 10 μm or lower, and a Vickers hardness number is in a range of 265 HV to 310 HV.

4 Claims, 10 Drawing Sheets

FOREIGN PATENT DOCUMENTS

| | | | |
|---|---|---|---|
| JP | 60-70120 | A | 4/1985 |
| JP | 63-103021 | A | 5/1988 |
| JP | 63-130245 | A | 6/1988 |
| JP | 63-241114 | A | 10/1988 |
| JP | 1-230713 | A | 9/1989 |
| JP | 2-205627 | A | 8/1990 |
| JP | 3-126812 | A | 5/1991 |
| JP | 4-14179 | B2 | 3/1992 |
| JP | 5-125441 | A | 5/1993 |
| JP | 6-179909 | A | 6/1994 |
| JP | 7-278734 | A | 10/1995 |
| JP | 8-277440 | A | 10/1996 |
| JP | 8-283899 | A | 10/1996 |
| JP | 409020922 | * | 1/1997 |
| JP | 10-265893 | A | 10/1998 |
| JP | 2000-129351 | A | 5/2000 |
| JP | 2001-123245 | A | 5/2001 |
| JP | 2002-129280 | A | 5/2002 |
| JP | 2003-147480 | A | 5/2003 |
| JP | 2003-193180 | A | 7/2003 |
| JP | 2003-342672 | A | 12/2003 |
| JP | 2006-2236 | A | 1/2006 |
| JP | 2007-204781 | A | 8/2007 |
| JP | 2009-263715 | A | 11/2009 |

* cited by examiner

STEEL PLATE THAT EXHIBITS EXCELLENT LOW-TEMPERATURE TOUGHNESS IN A BASE MATERIAL AND WELD HEAT-AFFECTED ZONE AND HAS SMALL STRENGTH ANISOTROPY, AND MANUFACTURING METHOD THEREOF

TECHNICAL FIELD

The present invention relates to a thick steel plate that exhibits excellent low-temperature toughness in a base material and a weld heat-affected zone and has small strength anisotropy, and a manufacturing method thereof. The steel plate manufactured according to the manufacturing method above may be employed in shipbuilding, bridges, building construction, marine structures, pressure vessels, tanks, pipe lines or other general types of welded structure, and in particular, is effective for use in a low-temperature field that requires a fracture toughness test at about −70° C.

The present application claims priority based on Japanese Patent Application No. 2008-256122 filed in Japan on Oct. 1, 2008 and Japanese Patent Application No. 2009-000202 filed in Japan on Jan. 5, 2009, the contents of which are cited herein.

BACKGROUND ART

Addition of Ni is effective in improving fracture toughness at a low temperature. For example, Patent Literature 1, Patent Literature 2, and Patent Literature 3 disclose a so-called 9% Ni steel (steel material containing Ni of about 8.5-9.5% by mass, having a tempered martensite structure, and mainly having excellent low-temperature toughness, for example, exhibiting excellent Charpy impact absorbing energy at −196° C.) as a type of steel used for an inner bath of a liquefied natural gas (LNG) tank.

Further, for example, Patent Literature 4 and Patent Literature 5 disclose a steel material containing Ni of about 4.0%, mainly having a tempered martensite structure, and having excellent low-temperature toughness, for example, exhibiting excellent Charpy impact absorbing energy at −70° C. as a type of steel for use in a ship.

While the low-temperature toughness can be improved by adding Ni, Ni segregates in the steel at the time of casting, and low-toughness structures are locally generated, possibly leading to a decrease in toughness in a weld heat-affected zone. Several methods for improving toughness have been proposed. For example, Patent Literature 6 discloses a method of performing a preliminary heat treatment for reducing the segregation before a casting slab is heated and rolled. Further, Patent Literature 7 discloses a method for reducing defects at a plate thickness center by dividing the rolling process into two processes. However, with the method disclosed in Patent Literature 6, the segregation reduction effect is not sufficient, and hence, a band-like Ni segregation remains, which reduces the toughness in the weld heat-affected zone. With the method disclosed in Patent Literature 7, a reduction ratio (thickness reduction ratio) from the casting slab to a final plate thickness (the reduction ratio is a value obtained by dividing a plate thickness before the rolling by a plate thickness after the rolling) is small, and the reduction ratio of a first hot rolling and temperatures are not controlled. Therefore, toughness of a base material and weld heat-affected zone decreases due to coarsening of the structure and the remaining segregation.

Further, Patent Literature 8 discloses a method using a TMCP (Thermomechanical Controlled Processing) in which water cooling is performed immediately after the rolling process, in order to manufacture a steel material having excellent toughness in a weld heat-affected zone. However, in a case where a low-temperature rolling is strengthened by using the TMCP, strength anisotropy becomes large, which causes a safety problem.

That is, it is difficult for the existing technique to manufacture a steel material that exhibits excellent low-temperature toughness in a base material and a weld heat-affected zone and has small strength anisotropy by using a steel material containing Ni.

RELATED ART LITERATURES

Patent Literatures

[Patent Literature 1] Japanese Unexamined Patent Application, First Publication No. H7-278734

[Patent Literature 2] Japanese Unexamined Patent Application, First Publication No. H6-179909

[Patent Literature 3] Japanese Unexamined Patent Application, First Publication No. S63-130245

[Patent Literature 4] Japanese Unexamined Patent Application, First Publication No. H1-230713

[Patent Literature 5] Japanese Unexamined Patent Application, First Publication No. S63-241114

[Patent Literature 6] Japanese Examined Patent Application, Second Publication No. H4-14179

[Patent Literature 7] Japanese Unexamined Patent Application, First Publication No. 2000-129351

[Patent Literature 8] Japanese Unexamined Patent Application, First Publication No. 2001-123245

DISCLOSURE OF THE INVENTION

Problems to be Solved by the Invention

Further, users desire that strength anisotropy be minimized; a base material have toughness of 150 J or over even at a low temperature of −70° C.; and, a weld heat-affected zone have toughness of 100 J or over even at a low temperature of −70° C. A problem to be solved by the present invention is to provide a steel plate that exhibits excellent low-temperature toughness in a base material and a weld heat-affected zone and has small strength anisotropy.

Means for Solving the Problems

The present invention provides a steel plate that exhibits excellent low-temperature toughness in a base material and a weld heat-affected zone and has small strength anisotropy, and a summary thereof is as follows:

(1) A first aspect of the present invention provides a steel plate that exhibits excellent low-temperature toughness in a base material and a weld heat-affected zone and has small strength anisotropy, wherein the steel plate includes, by mass, C: 0.04%-0.10%; Si: 0.02%-0.40%; Mn: 0.5%-1.0%; P: 0.0010%-0.0100%; S: 0.0001%-0.0050%; Ni: 2.0%-4.5%; Cr: 0.1%-1.0%; Mo: 0.1%-0.6%; V: 0.005%-0.1%; Al: 0.01%-0.08%; and N: 0.0001%-0.0070%, with the balance including Fe and inevitable impurities, a Ni segregation ratio at a portion located at one-fourth of a thickness of the steel plate in a steel-plate thickness direction from a surface of the steel plate is 1.3 or lower, a degree of flatness of a prior austenite grain is in a range from 1.05 to 3.0, an effective diameter of crystal grain is 10 μm or lower, and a Vickers hardness number is in a range of 265 HV to 310 HV.

(2) In the steel plate that exhibits excellent low-temperature toughness in the base material and the weld heat-affected zone and has small strength anisotropy according to (1) above, the steel plate may further include at least one or two components of, by mass, Nb: 0.005%-0.03%; Ti: 0.005%-0.03%; Cu: 0.01%-0.7%%; B: 0.0002%-0.05%; Ca: 0.0002%-0.0040%; and REM: 0.0002%-0.0040%, with the balance including Fe and inevitable impurities.

(3) A second aspect of the present invention provides a manufacturing method of a steel plate that exhibits excellent low-temperature toughness in a base material and a weld heat-affected zone and has small strength anisotropy, the steel plate including, by mass, C: 0.04%-0.10%; Si: 0.02%-0.40%; Mn: 0.5%-1.0%; P: 0.0010%-0.0100%; S: 0.0001%-0.0050%; Ni: 2.0%-4.5%; Cr: 0.1%-1.0%; Mo: 0.1%-0.6%; V: 0.005%-0.1%, Al: 0.01%-0.08%; and N: 0.0001%-0.0070%, with the balance including Fe and inevitable impurities, wherein the method includes: heating a casting slab having a thickness 5.5 times to 50 times thicker than a final plate thickness, to a temperature ranging from 1250° C. to 1380° C., and maintaining the temperature for eight hours or more; applying a first hot rolling to the casting slab at a reduction ratio of 1.2 to 10.0, and a temperature before a final rolling pass of 800° C. to 1250° C. to obtain a steel strip; air-cooling the steel strip to 300° C. or lower, and then heating the steel strip to a temperature ranging from 900° C. to 1270° C.; applying a second hot rolling to the steel strip at a reduction ratio of 2.0 to 40.0, and a temperature before a final rolling pass of 680° C. to 1000° C.; starting water-cooling within 100 seconds after the second hot rolling, and cooling the steel strip to a surface temperature of 200° C. or lower; and applying tempering to the steel strip at a temperature of 550° C. to 720° C.

(4) In the manufacturing method of the steel plate that exhibits excellent low-temperature toughness in the base material and the weld heat-affected zone and has small strength anisotropy according to (3) above, the steel plate may further include at least one or two components of, by mass, Nb: 0.005%-0.03%; Ti: 0.005%-0.03%; Cu: 0.01%-0.7%%; B: 0.0002%-0.05%; Ca: 0.0002%-0.0040%; and REM: 0.0002%-0.0040%, with the balance including Fe and inevitable impurities.

Effect of the Invention

According to the present invention, it is possible to use a steel plate that exhibits excellent low-temperature toughness in a base material and a weld heat-affected zone and has small strength anisotropy. More specifically, the present invention is an invention having an industrially high value because welding workability becomes more preferable as a welding heat input increases, and a degree of flexibility in designing becomes greater as a directional limitation at the time of using the steel plate less likely occurs.

EMBODIMENTS OF THE INVENTION

Figure 1:
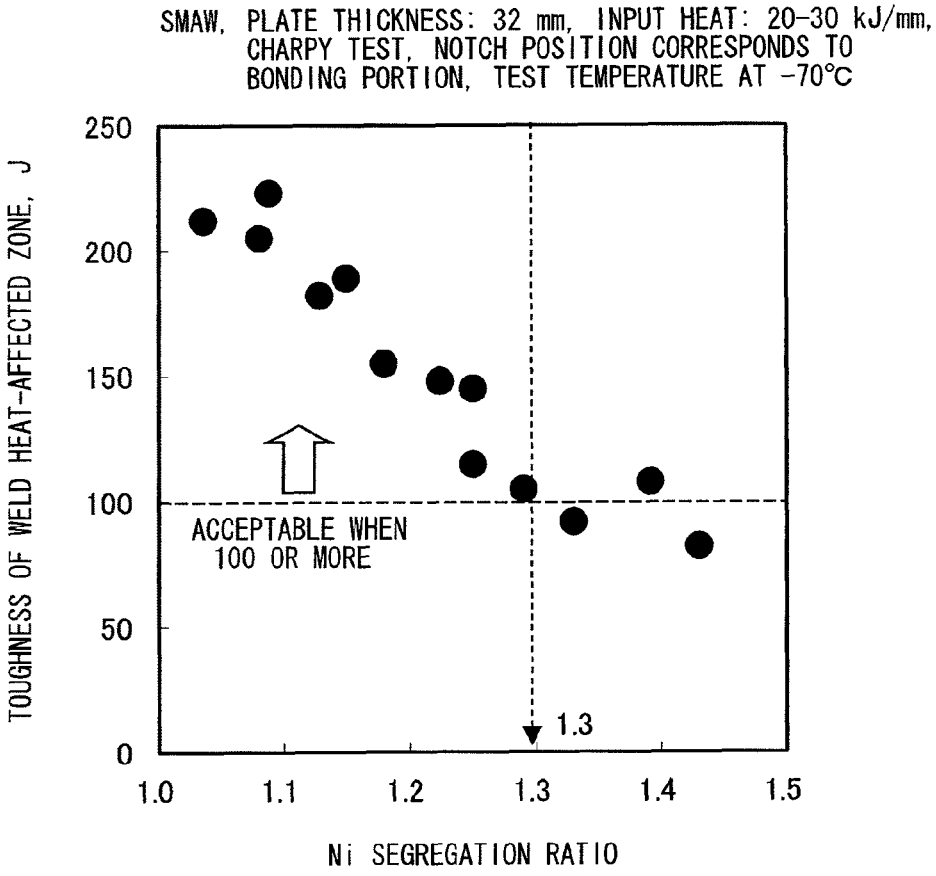
FIG. 1 is a graph showing a relationship between an Ni segregation ratio and toughness of a weld heat-affected zone.

The present invention will be described in detail.

The present inventors earnestly studied conditions for obtaining a Ni-added steel having excellent toughness in a base material and a weld heat-affected zone and having small strength anisotropy. As a result, the present inventors found that it is necessary to perform two hot rolling processes in a manufacturing process; it is necessary to employ a casting slab having a thickness necessary for obtaining a sufficient reduction ratio as a whole; and further, it is necessary to precisely control heating conditions, reduction ratios and temperatures at each of the hot rolling processes. The two hot rolling processes play their own respective roles. That is, a main role of the first hot rolling is to reduce a band-like Ni segregation specific to a hot rolling steel plate containing Ni, and a main role of the second hot rolling is to generate a hardened structure, make the structure finer and suppress a degree of flattening of the structure.

In the present invention, the most important condition is to employ a casting slab having a thickness sufficient for applying a desired pressing at the second hot rolling. The present inventors performed tests for evaluating the toughness of the base material and that of the weld heat-affected zone by using various steel plates manufactured by the hot rolling once or twice. As a result, as shown in Table 1, it is found that the two properties are excellent only in a case where the hot rolling is performed twice, and a total reduction ratio—obtained by dividing thickness of the casting slab by thickness of an obtained product—is 5.5 or more. When the total reduction ratio exceeds 50, productivity largely decreases, and hence, in the present invention, the total reduction ratio is specified to be in the range of 5.5 to 50. When the total reduction ratio is 7.5 or more, the toughness of the base material and the weld heat-affected zone improves, and hence the total reduction ratio is preferably set in the range of 7.5 to 50. When the total reduction ratio is 10 or more, the toughness of the base material and the weld heat-affected zone further improves, and hence, it is further preferable to specify the total reduction ratio in the range of 10 to 50. Note that, in Table 1, when the evaluation results of the toughness of the base material were 150 J or more, OK was applied, and when those of the base material were less than 150 J, NG was applied. Further, when the evaluation results of toughness of the weld heat-affected zone were 100 J or more, OK was applied, and when those of the weld heat-affected zone were less than 100 J, NG was applied. In the overall judgment, OK was applied when both evaluation results were OK, and NG was applied when either one or both of the evaluation results were NG.

TABLE 1

| Casting Thickness (mm) | Steel Plate Thickness (mm) | Total Reduction Ratio (%) | Rolling Times | Base Material Toughness (J) | Evaluation | Toughness of Weld Heat-Affected Zone (J) | Evaluation | Overall Judgement |
|---|---|---|---|---|---|---|---|---|
| 275 | 50 | 5.5 | Two | 151 | OK | 102 | OK | OK |
| 320 | 50 | 6.4 | Two | 175 | OK | 110 | OK | OK |
| 270 | 50 | 5.4 | Two | 136 | NG | 110 | OK | NG |
| 270 | 50 | 5.4 | Two | 62 | NG | 110 | OK | NG |
| 270 | 50 | 5.4 | Two | 145 | NG | 90 | NG | NG |
| 105 | 50 | 2.1 | Two | 78 | NG | 45 | NG | NG |
| 320 | 50 | 6.4 | One | 189 | OK | 78 | NG | NG |
| 380 | 50 | 7.6 | Two | 208 | OK | 125 | OK | OK |
| 420 | 50 | 8.4 | Two | 225 | OK | 205 | OK | OK |
| 650 | 50 | 13.0 | Two | 305 | OK | 235 | OK | OK |
| 650 | 14 | 46.4 | Two | 315 | OK | 303 | OK | OK |

The first hot rolling will be described in detail. A main purpose of the first hot rolling is to reduce the band-like Ni segregation specific to the Ni-added hot-rolling steel plate, in order to improve the toughness of the weld heat-affected zone. The present inventors earnestly studied a cause of a decrease in the low-temperature toughness of the Ni-added steel when used at about −70° C., in particular, a decrease in the toughness of the weld heat-affected zone when the high efficient welding is performed. As a result, it was found that one reason for the decrease in the toughness of the weld heat-affected zone lies in the band-like Ni segregation. The band-like Ni segregation is made such that Ni segregated at the time of solidification is formed into a band shape parallel to the rolling direction by the hot rolling process. With the development of the band-like Ni segregation, a zone having a low Ni concentration is formed locally, which reduces the toughness of the weld heat-affected zone.

The present inventors examined a relationship between a Ni segregation ratio and toughness of the weld heat-affected zone. A Charpy test piece with a plate thickness of 32 mm was obtained from a welded joint prepared under the condition of input heat of 29-30 kJ/mm by using SMAW (Shield Metal Arc Weld), and Charpy impact absorbing energy thereof is evaluated at −70° C. Note that a notch portion of the Charpy test piece was made corresponding to a bonding portion. As a result, as shown in FIG. 1, it was found that the weld heat-affected zone exhibits excellent toughness when the Ni segregation ratio at a portion (hereinafter, referred to as "one-fourth t portion") located at one-fourth of the thickness below a surface of the steel plate in the thickness direction of the steel plate is 1.3 or lower. Therefore, in the present invention, the Ni segregation ratio at the one-fourth t portion is specified to be 1.3 or lower. Note that the weld heat-affected zone exhibits the excellent toughness when the segregation ratio at the one-fourth t portion is 1.2 or lower, and hence, it is desirable for the Ni segregation ratio to be 1.2 or lower. Further, the weld heat-affected zone exhibits the excellent toughness when the segregation ratio at the one-fourth t portion is 1.1 or lower, and hence, it is desirable for the Ni segregation ratio to be 1.1 or lower. The segregation ratio at the one-fourth t portion can be measured by using an EPMA (Electron Probe Micro Analyzer). Data concerning Ni amount are measured at 400 points at 5 μm intervals for the length of 2 mm in the plate thickness direction and around the portion located inwardly at one-fourth of the thickness below the steel plate surface in the plate thickness direction. After the largest five values and the smallest five values are removed from the total measured data, an average of the remaining 390 data is defined as an average value, and an average value of the largest 10 values among the remaining 390 data is defined as a maximum value. Then, a value obtained by dividing the maximum value by the average value is defined as a segregation ratio at the one-fourth t portion. A lower limit value of the segregation ratio is not required from the viewpoint of toughness of the weld heat-affected zone, and thus is not specified. In theory, however, the value is 1.0. Note that the excellent toughness of the weld heat-affected zone as used in the present invention means that the toughness of the weld heat-affected zone at −70° C. is 100 J or more as described above, in other words, the absorption energy of the weld heat-affected zone in the Charpy test at −70° C. is 100 J or more.

Figure 2:
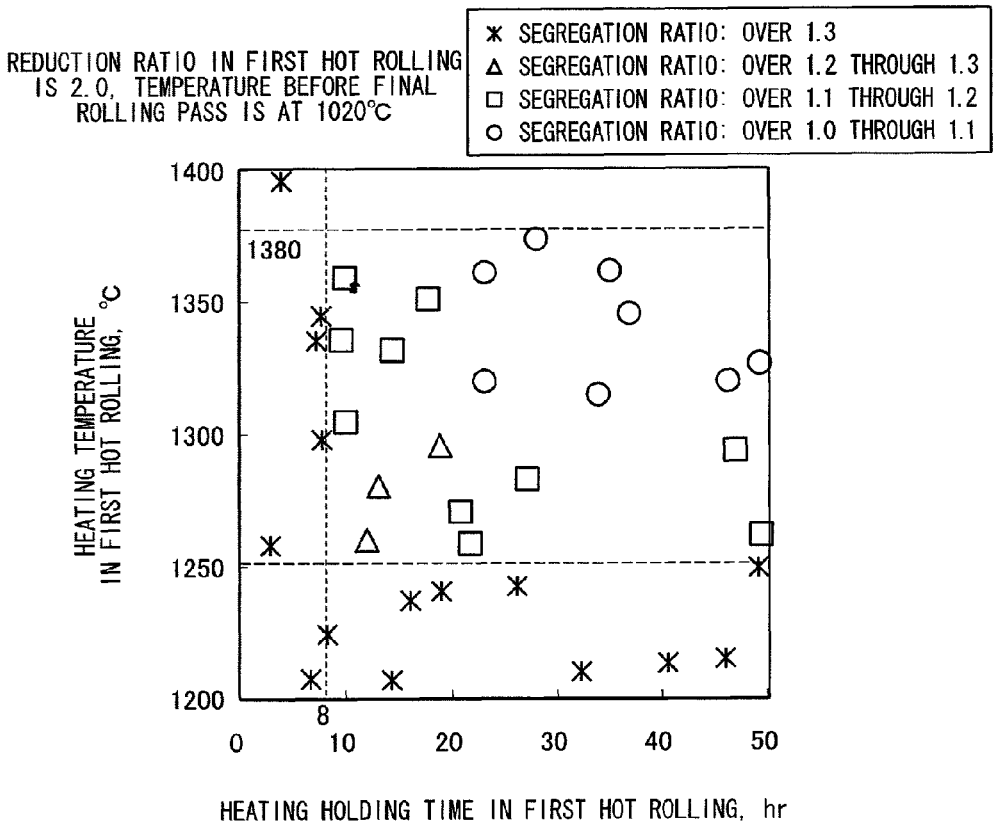
FIG. 2 is a graph showing an impact of a heating temperature and a holding time at a time of a first hot rolling on the Ni segregation ratio.

To achieve the segregation ratio described above, it is necessary to specify a heating temperature, holding time, reduction ratio, and rolling temperature at the time of the first hot rolling. Here, the heating temperature refers to a surface temperature of a slab before passing through a first rolling pass. The holding time refers to a period of time starting from a time when three hours have elapsed since the slab surface reaches the heating temperature, until the slab is extracted from a heating furnace. Regarding the heating temperature and the holding time, as the temperature becomes higher and as the holding time becomes longer, the Ni segregation ratio becomes smaller due to dispersion. The present inventors examined an effect of a combination of the heating temperature and the holding time of the first hot rolling on the segregation ratio. More specifically, the first hot rolling was performed under the condition where the reduction ratio is 2.0 and the final temperature before the final rolling pass is 1020° C. As a result, as shown in FIG. 2, it was found that it is necessary to perform the first hot rolling at the heating temperature of 1250° C. or more for eight hours or more in order to achieve the Ni segregation ratio of 1.3 or lower at the one-fourth t portion. Therefore, in the present invention, it is specified that the first hot rolling be performed at the heating temperature of 1250° C. or more for eight hours or more. Note that the productivity largely decreases when the heating temperature is set at 1380° C. or more and the holding time is set at 50 hours, and hence the upper limit of the heating temperature is set at 1380° C. and that of the holding time is set at 50 hours or lower. Note that the Ni segregation ratio further decreases when the heating temperature is set at 1300° C. or more and the holding time is set at 20 hours or more, and hence it is desirable for the heating temperature and the holding time to be set at 1300° C. or more and 20 hours or more, respectively.

Figure 3:
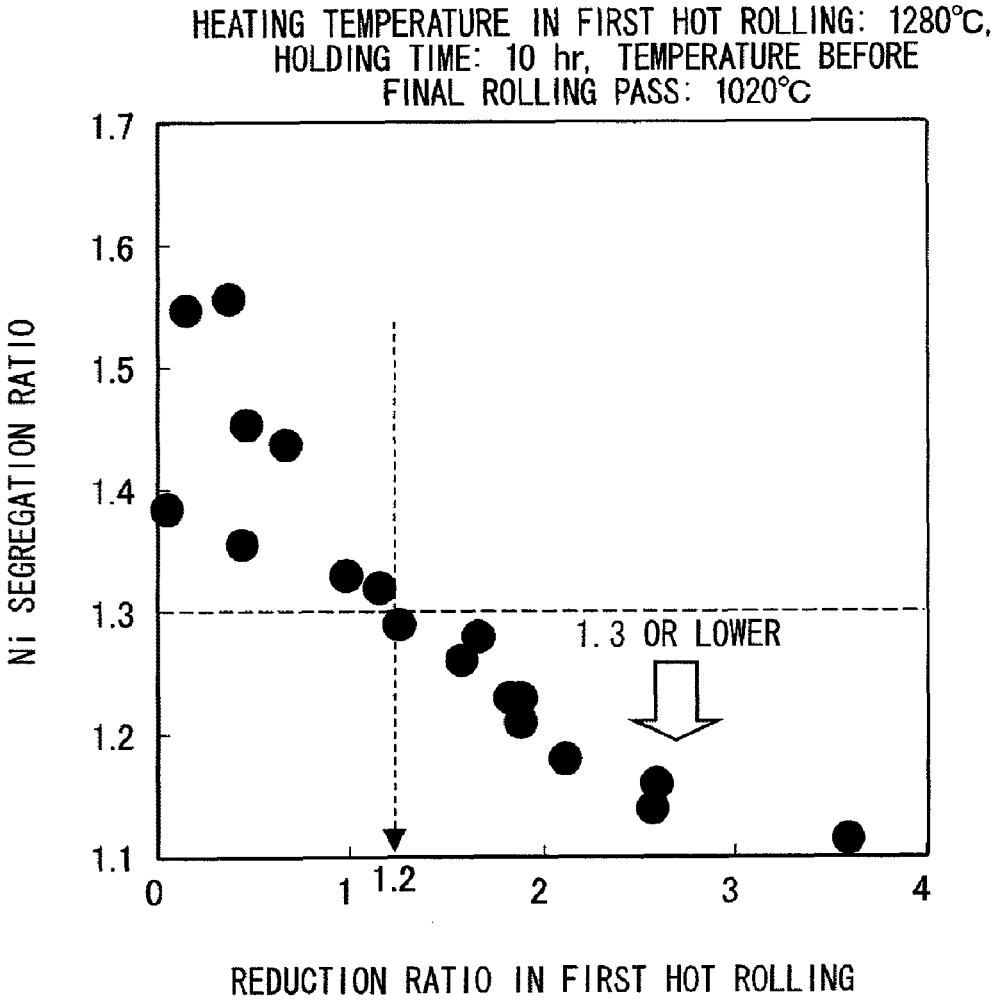
FIG. 3 is a graph showing a relationship between the Ni segregation ratio and a reduction ratio of the first hot rolling.

The segregation reduction effect described above can be expected even at a time of biting during the first hot rolling and at air cooling after the rolling. This is because a segregation reduction effect resulting from grain boundary migration works when recrystallization occurs, and a segregation reduction effect resulting from diffusion under a high dislocation density works when recrystallization does not occur. Therefore, as the reduction ratio of the first hot rolling increases, the band-like Ni segregation ratio decreases. The present inventors examined effects of the reduction ratio of the first hot rolling on the segregation ratio. More specifically, the first hot rolling was performed under the condition where the heating temperature is 1280° C., the holding time is 10 hours, and the temperature before the final rolling pass is 1020° C. As a result, as shown in FIG. 3, it was found that it is necessary to set the reduction ratio at 1.2 or more in order to obtain the Ni segregation ratio of 1.3 or less. The productivity largely decreases when the reduction ratio exceeds 10. Therefore, the reduction ratio of the first hot rolling is specified to be in a range of 1.2 to 10. Further, since the segregation ratio becomes smaller when the reduction ratio is 2.0 or more, it is desirable for the reduction ratio to be in the range of 2.0 to 10.

Figure 4:
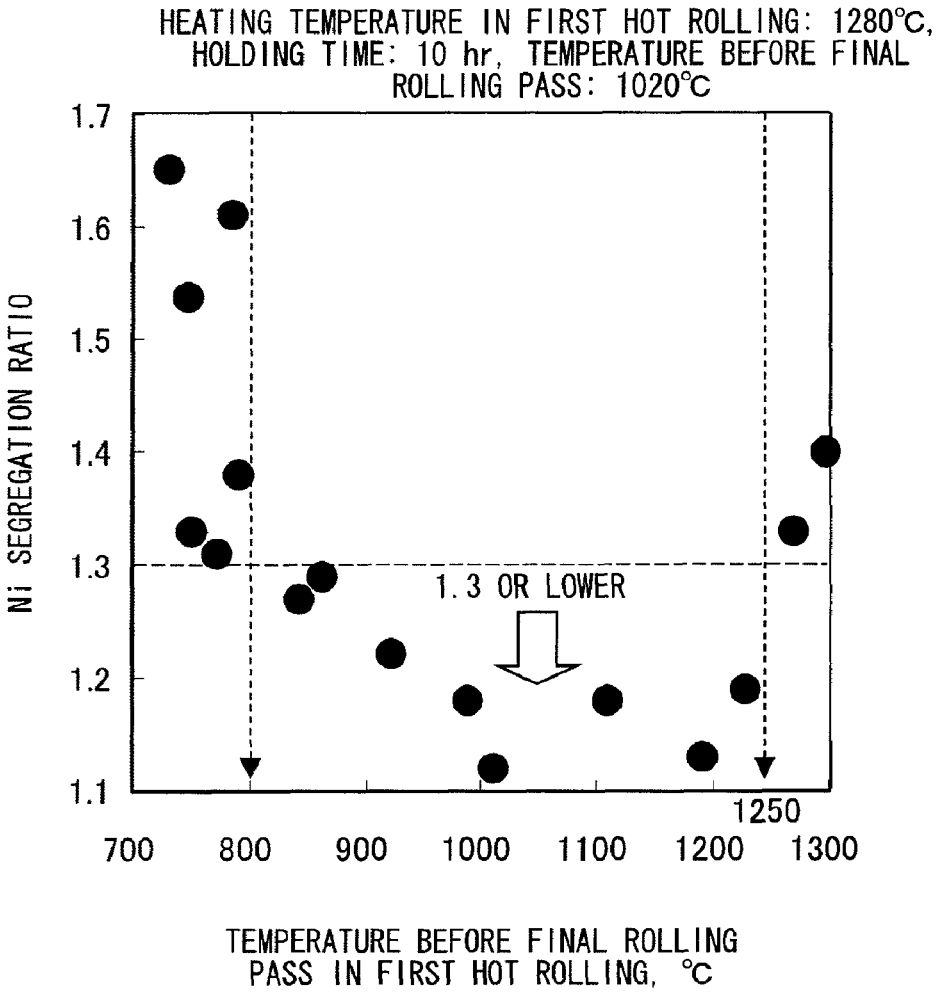
FIG. 4 is a graph showing a relationship between the Ni segregation ratio and a temperature before a final rolling pass of the first hot rolling.

It is extremely important to control the temperature before the final rolling pass to be an appropriate temperature at the time of the first hot rolling. This is because diffusion does not develop at the time of air cooling after the rolling is completed and the segregation ratio deteriorates when the temperature before the final rolling pass is too low, and on the other hand, when the temperature before the final rolling pass is too high, the dislocation density rapidly decreases due to the recrystallization, and the diffusion effect under the high dislocation density at the time of air cooling after the rolling is completed decreases, which leads to the deteriorated segregation ratio. In the first hot rolling, there exists a temperature range that allows an appropriate amount of dislocation to remain and that promotes diffusion. The present inventors examined a relationship between the temperature before the final rolling pass of the first hot rolling and the segregation ratio. More specifically, the first hot rolling was performed under the condition where the heating temperature is 1290° C., the holding time is 10 hours, and the temperature before the final rolling pass is 1020° C. at the time of the first hot rolling. As a result, as shown in FIG. 4, it was found that the segregation ratio becomes extremely high at temperatures of less than 800° C. and of over 1250° C. Therefore, the temperature before the final rolling pass of the first hot rolling is specified to be in a range of 800° C. to 1250° C. Note that, since the reduction effect on the segregation ratio becomes further greater when the temperature before the final rolling pass is in the range of 950° C. to 1150° C., it is desirable for the temperature before the final rolling pass of the first hot rolling to be in the range of 950° C. to 1150° C. It is preferable that an air cooling be performed after the rolling. The air cooling after the rolling makes the diffusion of the Ni further develop, which leads to reduction in the segregation. Note that transformation is not completed and material properties become nonuniform when the temperature after the first hot rolling and the air cooling and before a second hot rolling exceeds 300° C., and hence, a temperature of a surface of a steel strip at the beginning of the second hot rolling after the first hot rolling and the air cooling is set at a temperature of 300° C. or lower.

Note that the heating temperature refers to a temperature of a slab surface. The holding temperature refers to a period of time starting from a time when three hours have elapsed since the slab surface reaches the heating temperature, until the slab is extracted from a heating furnace. The reduction ratio is a value obtained by dividing a plate thickness before the rolling by a plate thickness after the rolling. The temperature before the final rolling pass refers to a temperature of the slab surface measured immediately before the biting of the final rolling pass of rolling, and can be measured by using a radiation thermometer and the like. The air cooling is performed such that a surface temperature of the steel plate is in the range of 500° C. to 800° C., and cooling rate is 5° C./s or lower.

Next, the second hot rolling process will be described. A main purpose of the second hot rolling is to secure a strength by generating a hardened structure, improve the toughness of the base material by making the structure finer, and reduce strength anisotropy by suppressing a degree of flattening of the structure.

Since the material is to be used in the welded structure, it is necessary to secure the strength by generating the hardened structure. When the Vickers hardness number is less than 265 HV, it is necessary for a thickness of the steel plate to be large, which causes deterioration of fuel consumption due to an increase in weight of the structure, and an increase in welding work cost. On the other hand, when the Vickers hardness number exceeds 310 HV, the toughness of the weld heat-affected zone is reduced, which makes it impossible to apply welding with high efficiency. Therefore, the Vickers hardness number is specified to be in a range from 265 HV to 310 HV. Note that the Vickers hardness number represents an average value of five points measured under a load of 10 kgf at a portion located at one-fourth of the thickness of the steel plate below the surface of a sample that is cut out from the steel plate and whose surface are parallel to a rolling direction and a thickness direction of the steel plate.

Figure 5:
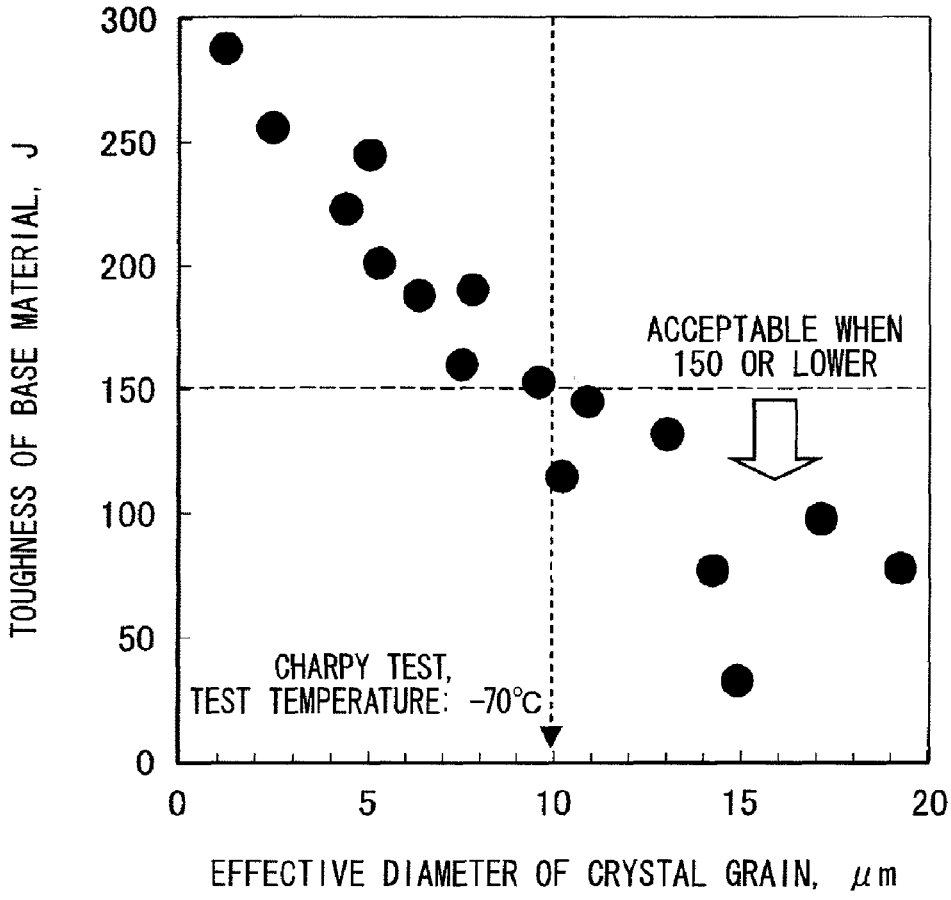
FIG. 5 is a graph showing a relationship between an effective diameter of crystal grain and a toughness of a base material.

In the second hot rolling, it is necessary to make the structure finer in order to improve the toughness of the base material. Within the strength range according to the present invention, a main structure is martensite, and, an effective grain diameter thereof corresponds to a region surrounded by large angle boundaries, that is, an effective diameter of crystal grain. The toughness of the base material improves as the effective diameter of crystal grain becomes finer. The present inventors examined a relationship between the effective diameter of crystal grain and the toughness of the base material, and as a result, obtained the relationship as shown in FIG. 5. When the effective diameter of crystal grain exceeds 10 μm, the toughness of the base material decreases, and hence, the effective diameter of crystal grain is specified to be 10 μm or less. The smaller the effective crystal grain is, the more desirable. However, the productivity largely decreases when the effective diameter of crystal grain is less than 1 μm, and hence, the lower limitation of the effective diameter of crystal grain is set at 1 μm. Note that the toughness of the base material further improves when the effective diameter of crystal grain is less than 6 μm, and hence, it is desirable for the effective diameter of crystal grain to be in the range of 1 μm to 6 μm. Further, the toughness of the base material still further improves when the effective diameter of crystal grain is less than 3 μm, and hence, it is desirable for the effective diameter of crystal grain to be in the range of 1 μM to 3 μm. Note that the effective diameter of crystal grain can be estimated by observing a vicinity of a starting point of brittle fracture of the fractured surface after the Charpy test, quantifying areas of the large number of cleaved fracture face, and calculating an average of circle-equivalent diameter. In the present invention, the excellent toughness of the base material means that the absorption energy of the weld heat-affected zone in the Charpy test at −70° C. is 150 J or more.

Figure 6:
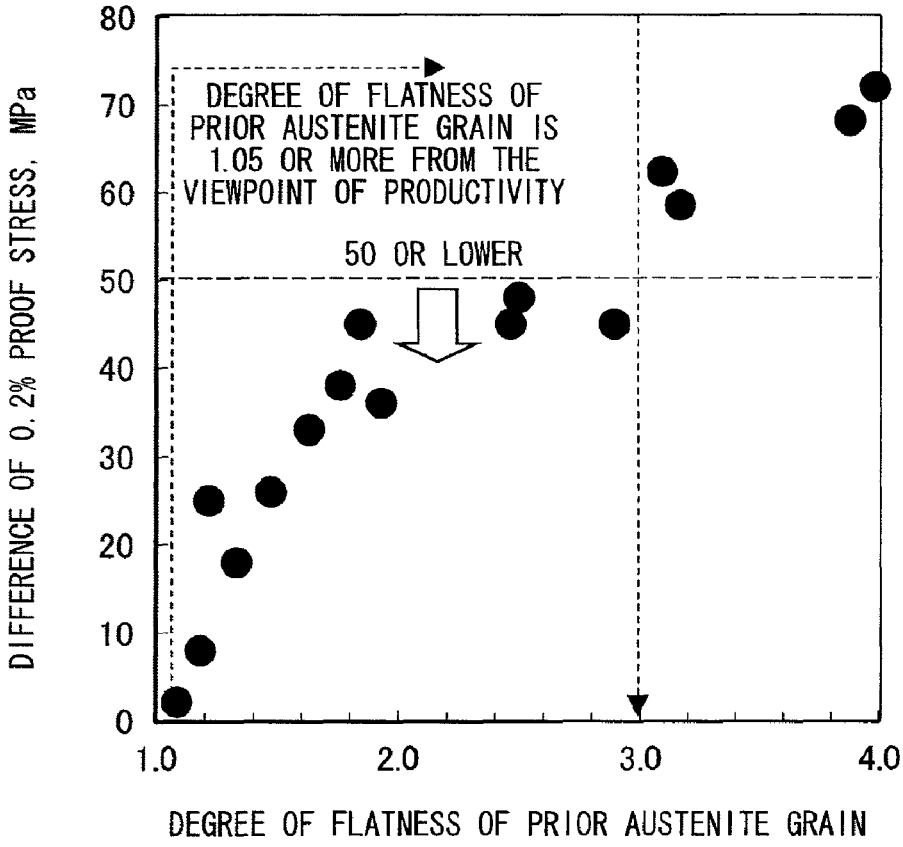
FIG. 6 is a graph showing a relationship between a degree of flatness of a prior austenite grain and a difference of 0.2% proof stress.

In the second hot rolling, it is necessary to make the strength anisotropy smaller. The strength anisotropy tends to be larger, as a degree of the rolling is made stronger in the unrecrystallization temperature range and a degree of flatness of prior austenite grain becomes greater. Therefore, it is necessary to make the degree of flatness of the prior austenite grain smaller. The present inventors examined an effect of the degree of flatness of the prior austenite grain on the strength anisotropy, and obtained results shown in FIG. 6. Here, evaluation of the strength anisotropy is made on the basis of a difference of 0.2% proof stress between a test piece taken perpendicular to the rolling direction and a test piece taken parallel to the rolling direction, and the small strength anisotropy means that the difference of 0.2% proof stress is 50 MPa or lower. According to FIG. 6, the strength anisotropy becomes larger when the degree of flatness of the prior austenite exceeds 3.0, and hence, the degree of flatness of the prior austenite is specified to be 3.0 or lower. The productivity largely decreases when the degree of flatness of the prior austenite is less than 1.05, and hence, the lower limitation of the degree of flatness of the prior austenite is specified to be 1.05. Note that the strength anisotropy further decreases when the degree of flatness of the prior austenite is 1.6 or lower, and hence it is desirable for the degree of flatness of the prior austenite to be in the range of 1.05 to 1.6. Further, the strength anisotropy still further decreases when the degree of flatness of the prior austenite is 1.2 or lower, and hence it is desirable for the degree of flatness of the prior austenite to be in the range of 1.05 to 1.2. The degree of flatness of the prior austenite is calculated in the following manner. That is, the structure is observed at a portion located at one-fourth of the thickness of the steel plate below the surface of a sample that is cut out from the steel plate and whose surfaces are parallel to a rolling direction and a thickness direction of the steel plate, by using an optical microscope having a mesh-added eyepiece lens, and calculation is made to obtain the ratio of the number of the prior austenite grain boundaries crossing a line segment extending along the longitudinal direction of rolling relative to the number of the prior austenite grain boundaries crossing a line segment extending with the same length and along the thickness direction perpendicular to the rolling direction, thereby obtaining the degree of flatness of the prior austenite grain.

Figure 7:
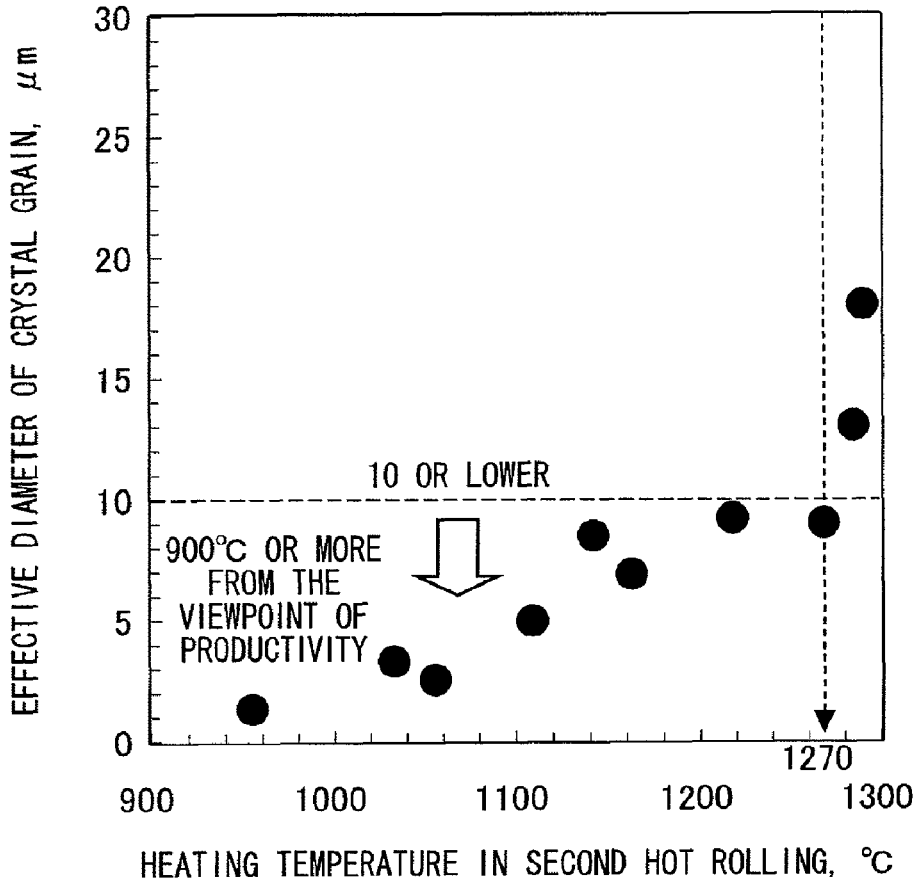
FIG. 7 is a graph showing a relationship between the effective diameter of crystal grain and a heating temperature at the time of a second hot rolling.

To achieve the effective diameter of crystal grain and the degree of flatness of the prior austenite grain described above, it is necessary to specify a heating temperature, reduction ratio, and rolling temperature at the time of the second hot rolling. As the heating temperature at the time of the second hot rolling increases, austenite coarsens and the effective diameter of crystal grain becomes larger. The present inventors examined a relationship between the effective diameter of crystal grain and the heating temperature, and found that the heating temperature is necessary to be 1270° C. or lower in order to obtain the effective diameter of crystal grain of 10 μm or lower, as shown in FIG. 7. Further, the productivity largely decreases when the heating temperature is less than 900° C. Therefore, the heating temperature at the time of the second hot rolling is specified to be in the range of 900° C. to 1270° C. Note that it is expected that the effective diameter of crystal grain becomes 5 μm or lower by setting the heating temperature at 1120° C. or lower. Therefore, it is desirable that the heating temperature at the second hot rolling be in the range of 900° C. to 1120° C. Although the holding time at the time of heating in the second hot rolling is not specified, it is desirable that the holding time be in the range of 2 hours to 10 hours from the viewpoint of ensuring uniform heating and productivity.

Figure 8:
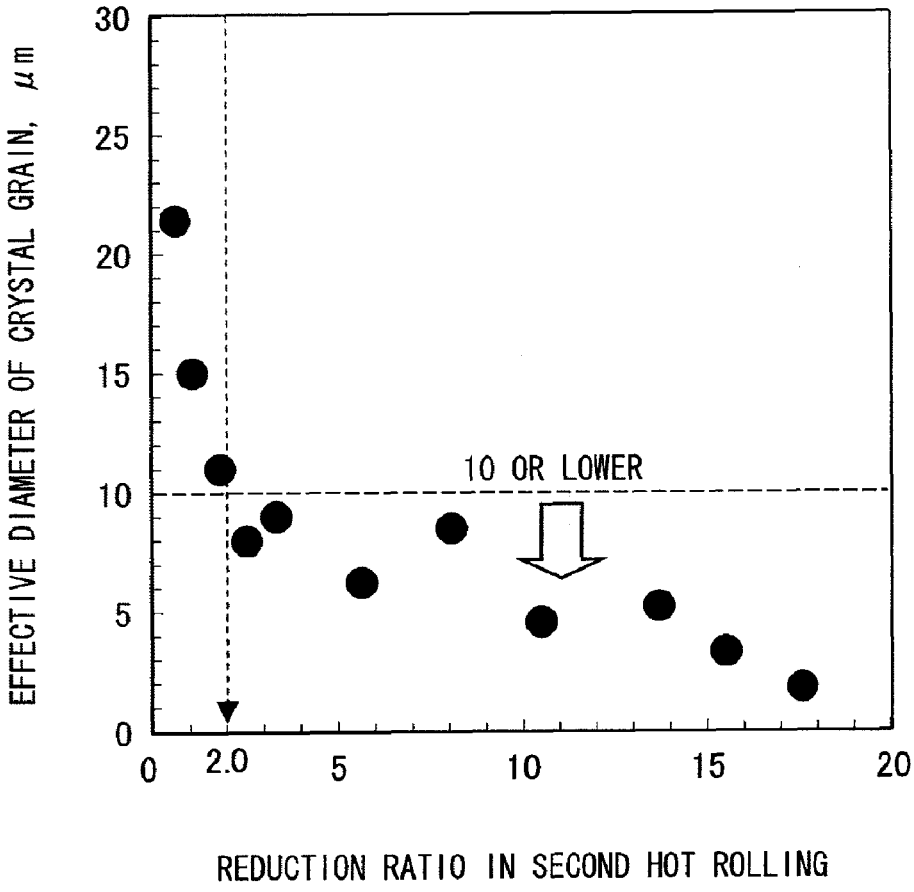
FIG. 8 is a graph showing a relationship between the effective diameter of crystal grain and a reduction ratio of the second hot rolling.

The reduction ratio of the second hot rolling is important. As the reduction ratio becomes larger, the recrystallization or the dislocation density increases, and the effective diameter of crystal grain becomes small. The present inventors examined a relationship between the effective diameter of crystal grain and the reduction ratio. As a result, the present inventors found that the reduction ratio is necessary to be 2.0 or lower in order to obtain the effective diameter of crystal grain of 10 μm or lower, as shown in FIG. 8. Further, the productivity largely decreases when the reduction ratio exceeds 40. Therefore, the reduction ratio of the second hot rolling is specified to be in the range of 2.0 to 40. Note that the effective diameter of crystal grain becomes further finer when the reduction ratio of the second hot rolling is 10 or more, and hence, it is desirable that the reduction ratio be in the range of 10 to 40.

Figure 9:
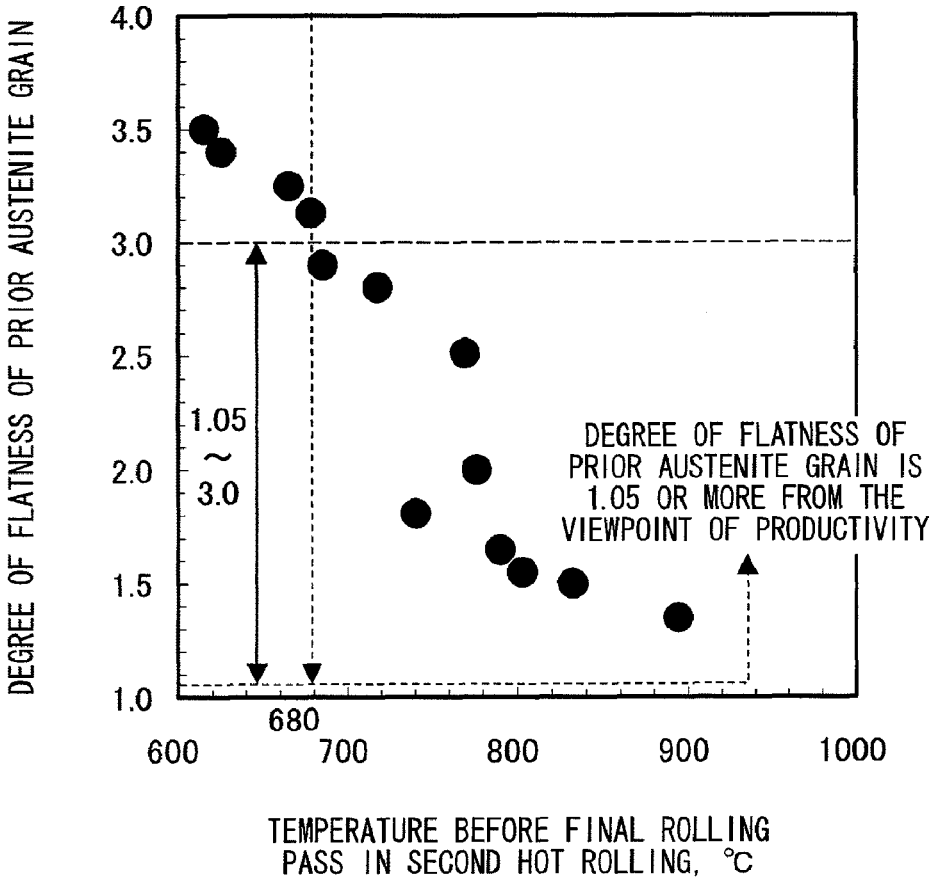
FIG. 9 is a graph showing a relationship between the degree of flatness of the prior austenite grain and a temperature before a final rolling pass of the second hot rolling; and, FIG. 10 is a graph showing a relationship between the effective diameter of crystal grain and the temperature of the final rolling pass of the second hot rolling.
Figure 10:
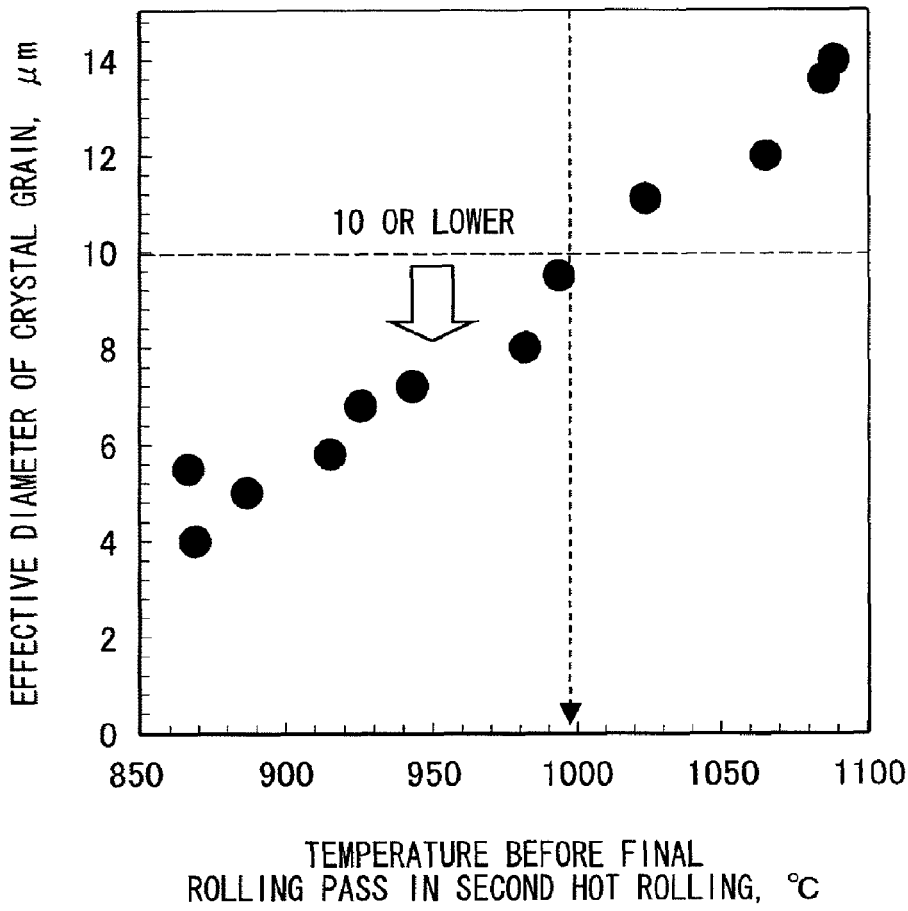

Further, the temperature before the final rolling pass of the second hot rolling is also important. The degree of flatness of the prior austenite grain becomes greater as the temperature before the final rolling pass becomes lower, while the effective diameter of crystal grain becomes larger as the temperature before the final rolling pass becomes higher. The present inventors examined the temperature before the final rolling pass, at which it is possible to obtain both the degree of flatness of the prior austenite grain of 3.0 or lower and the effective diameter of crystal grain of 10 μm or lower. As a result, the present inventors found that the degree of flatness of the prior austenite grain becomes greater when the temperature before the final rolling pass is less than 680° C. as shown in FIG. 9, and the effective diameter of crystal grain increases when the temperature before the final rolling pass exceeds 1000° C. as shown in FIG. 10. Therefore, the temperature before the final rolling pass of the second hot rolling is specified to be in the range of 680° C. to 1000° C. Note that the degree of flatness of the prior austenite grain and the effective diameter of crystal grain become further smaller when the temperature before the final rolling pass is in the range of 800° C. to 920° C., and hence, it is desirable for the temperature before the final rolling pass to be in the range of 800° C. to 920° C.

Hereinbelow, manufacturing conditions other than the hot rolling will be described. It is preferable that water cooling be performed immediately after the rolling. It is desirable that the water cooling start within 100 seconds after the rolling, and the water cooling terminate at a temperature of 200° C. or lower. This makes it possible for the Vickers hardness number to be 265 HV or more. After the water cooling, tempering is performed. The toughness of the base material decreases when a heating temperature at the time of tempering is lower than 550° C., and on the other hand, the strength of the base material is insufficient when the heating temperature exceeds 720° C. Therefore, the heating temperature at the time of tempering is specified to be in the range of 550° C. to 720° C. Note that either of air cooling or water cooling may be possible after the tempering. Further, the water cooling is performed such that a temperature of the steel plate surface is in the range of 500° C. to 800° C., and a cooling rate exceeds 5° C./sec.

Hereinbelow, ranges of other alloying elements are specified.

C is an element essential for securing the strength, and the amount of C added is set at 0.04% or more. However, the increase in the amount of C causes a decrease in the toughness of the base material and decrease in weldability due to generation of coarsening precipitate, and hence, the upper limit thereof is set at 0.10%.

Si is an element essential for securing the strength, and the amount of Si added is set at 0.02% or more. However, the increase in the amount of Si causes a decrease in weldability, and hence, the upper limit thereof is set at 0.40%.

Mn is an element essential for securing the strength, and addition of at least 0.5% or more of Mn is necessary. However, when the amount of Mn added exceeds 1.0%, the tempering embrittlement susceptibility increases, and performance concerning resistance to brittle fracture deteriorates. Hence, the amount of Mn added is specified to be in the range of 0.5% to 1.0%.

When the amount of P added is less than 0.0010%, the productivity largely decreases due to the increase in the refinement load. On the other hand, when the amount of P exceeds 0.0100%, performance concerning resistance to brittle fracture deteriorates due to promotion of tempering embrittlement. Therefore, the amount of P added is specified to be in the range of 0.0010% to 0.0100%.

When the amount of S added is less than 0.0001%, the productivity largely decreases due to an increase in a refinement load, and on the other hand, when the amount of S added exceeds 0.0050%, the toughness deteriorates. Therefore, the amount of S added is specified to be in the range of 0.0001% to 0.0050%.

Ni is an element effective for improving a property of resistance to brittle fracture. The degree of improvement in the property of resistance to brittle fracture is small when the amount of Ni added is less than 2.0%, and on the other hand, manufacturing cost increases when the amount of Ni added exceeds 4.5%. Therefore, the amount of Ni added is specified to be in the range of 2.0% to 4.5%. Note that cost of alloying can be further reduced when the amount of Ni is 3.6% or lower, and hence it is desirable for the amount of Ni added to be in the range of 2.0% to 3.6%.

Cr is an element effective for increasing the strength. Addition of at least 0.1% or more of Cr is necessary to obtain this effect, and on the other hand, the toughness of the weld heat-affected zone decreases when the amount of Cr added exceeds 1.0%. Therefore, the amount of Cr added is specified to be in the range of 0.1% to 1.0%.

Mo is an element effective for increasing the strength without increasing the tempering embrittlement susceptibility. The effect of increasing the strength is small when the amount of Mo added is less than 0.1%. On the other hand, when the amount of Mo added exceeds 0.6%, the manufacturing cost increases, and the toughness of the weld heat-affected zone decreases. Therefore, the amount of Mo added is specified to be in the range of 0.1% to 0.6%. Note that the manufacturing cost further decreases when the amount of Mo added is 0.3% or lower, and hence, it is desirable that the amount of Mo be in the range of 0.1% to 0.3%.

V is an element effective for securing the strength. This effect is small when the amount of V added is less than 0.005%. On the other hand, the addition of V of over 0.1% leads to a decrease in the toughness of the weld heat-affected zone. Therefore, the amount of V added is specified to be in the range of 0.005% to 0.1%.

Al is an element effective as a deoxidizing agent. When the amount of Al added is less than 0.01%, the deoxidizing effect is not sufficient, which leads to a decrease in the toughness of the base material. On the other hand, the toughness of the weld heat-affected zone decreases when the amount of Al added exceeds 0.08%. Therefore, the amount of Al added is specified to be in the range of 0.01% to 0.08%.

When the amount of N added is less than 0.0001%, the productivity decreases due to the increase in the refinement load. On the other hand, the toughness of the weld heat-affected zone decreases when the amount of N added exceeds 0.007%. Therefore, the amount of N added is specified to be in the range of 0.0001% to 0.007%.

Note that, in the present invention, the following elements may be further added.

Nb is an element effective for securing the strength. This effect is small when the amount of Nb added is less than 0.005%. On the other hand, the addition of Nb of over 0.03% leads to a decrease in the toughness of the weld heat-affected zone. Therefore, the amount of Nb added is specified to be in the range of 0.005% to 0.03%.

Ti is an element effective for improving the toughness. This effect is small when the amount of Ti added is less than 0.005%. On the other hand, the addition of Ti of over 0.03% leads to a decrease in the toughness of the weld heat-affected zone. Therefore, the amount of Ti added is specified to be in the range of 0.005% to 0.03%.

Cu is an element effective for securing the strength. This effect is small when the amount of Cu added is less than 0.01%. On the other hand, the addition of Cu of over 0.7% leads to a decrease in the toughness of the weld heat-affected zone. Therefore, the amount of Cu added is specified to be in the range of 0.01% to 0.7%.

B is an element effective for securing the strength. This effect is small when the amount of B added is less than 0.0002%. On the other hand, the addition of B of over 0.05% leads to a decrease in the toughness of the base material. Therefore, the amount of B added is specified to be in the range of 0.0002% to 0.05%.

Ca is an element effective for preventing a nozzle from clogging. This effect is small when the amount of Ca added is less than 0.0002%. On the other hand, the addition of Ca of over 0.0040% leads to a decrease in the toughness. Therefore, the amount of Ca added is specified to be in the range of 0.0002% to 0.0040%.

REM is an element effective for improving the toughness of the weld heat-affected zone. This effect is small when the amount of REM added is less than 0.0002%. On the other hand, the addition of REM of over 0.0040% leads to a decrease in the toughness. Therefore, the amount of REM added is specified to be in the range of 0.0002% to 0.0040%.

Even when Zn, Sn, Sb, Zr, Mg and the like, which possibly enter as inevitable impurities eluted from the used raw materials including the added alloys or a furnace material during melting and manufacturing processes, get into the steel during melting and manufacturing the steel according to the present invention, the effects obtained by the present invention do not deteriorate, provided that the entering amount is less than 0.002%.

EXAMPLES

For steel plates having a plate thickness of 6 mm to 50 mm and manufactured with various chemical components and under various manufacturing conditions, evaluation has been made as to a yield stress and a tensile strength of the base material, the Charpy impact absorbing energy of the base material, and the Charpy impact absorbing energy of the weld heat-affected zone. Table 2 shows a plate thickness, chemical components, manufacturing method, Ni segregation ratio, Vickers hardness number, effective diameter of crystal grain, and degree of flatness of prior austenite grain of steel plates of Examples 1-13 and Comparative Examples 1-13. Table 3 shows a plate thickness, chemical components, manufacturing method, Ni segregation ratio, Vickers hardness number, effective diameter of crystal grain, and degree of flatness of prior austenite grain of steel plates of Examples 14-26 and Comparative Examples 14-26.

TABLE 2

| | Casting Slab Thickness mm | Middlepoint Slab Thickness mm | Final Thickness mm | Total Reduction Ratio | C | Si | Mn | P | S mass % | Ni | Cr | Mo | V | Al |
|---|---|---|---|---|---|---|---|---|---|---|---|---|---|---|
| Example 1 | 250 | 30 | 12 | 20.8 | 0.06 | 0.06 | 0.65 | 0.0012 | 0.0020 | 4.3 | 0.8 | 0.33 | 0.06 | 0.04 |
| Comperative Example 1 | 250 | 30 | 12 | 20.8 | 0.06 | 0.06 | 0.64 | 0.0012 | 0.0020 | 4.4 | 0.8 | 0.34 | 0.06 | 0.04 |
| Example 2 | 330 | 63 | 25 | 13.2 | 0.07 | 0.29 | 0.91 | 0.0040 | 0.0033 | 3.7 | 0.6 | 0.35 | 0.08 | 0.01 |
| Comperative Example 2 | 330 | 63 | 25 | 13.2 | 0.07 | 0.30 | 0.93 | 0.0040 | 0.0033 | 3.8 | 0.6 | 0.35 | 0.08 | 0.01 |
| Example 3 | 410 | 250 | 50 | 8.2 | 0.09 | 0.39 | 0.91 | 0.0059 | 0.0029 | 4.1 | 0.3 | 0.49 | 0.04 | 0.06 |
| Comperative Example 3 | 410 | 380 | 50 | 8.2 | 0.09 | 0.38 | 0.93 | 0.0060 | 0.0029 | 4.2 | 0.3 | 0.49 | 0.04 | 0.06 |
| Example 4 | 550 | 120 | 12 | 45.8 | 0.04 | 0.25 | 0.85 | 0.0083 | 0.0020 | 4.0 | 0.6 | 0.45 | 0.04 | 0.02 |
| Comperative Example 4 | 550 | 120 | 12 | 45.8 | 0.04 | 0.41 | 0.78 | 0.0110 | 0.0020 | 4.0 | 0.6 | 0.45 | 0.04 | 0.02 |
| Example 5 | 700 | 300 | 25 | 28.0 | 0.08 | 0.18 | 0.93 | 0.0076 | 0.0039 | 3.1 | 0.6 | 0.12 | 0.05 | 0.07 |
| Comperative Example 5 | 700 | 300 | 25 | 28.0 | 0.08 | 0.18 | 0.91 | 0.0078 | 0.0041 | 1.9 | 0.6 | 0.12 | 0.05 | 0.07 |
| Example 6 | 320 | 111 | 50 | 6.4 | 0.09 | 0.34 | 0.67 | 0.0063 | 0.0019 | 3.5 | 0.8 | 0.35 | 0.05 | 0.04 |
| Comperative Example 6 | 320 | 125 | 50 | 6.4 | 0.09 | 0.34 | 0.68 | 0.0063 | 0.0019 | 3.5 | 0.8 | 0.36 | 0.05 | 0.04 |
| Example 7 | 330 | 34 | 12 | 27.5 | 0.08 | 0.27 | 0.52 | 0.0014 | 0.0038 | 2.6 | 0.4 | 0.35 | 0.01 | 0.03 |
| Comperative Example 7 | 330 | 34 | 12 | 27.5 | 0.08 | 0.28 | 0.54 | 0.0015 | 0.0039 | 2.7 | 0.4 | 0.35 | 0.01 | 0.03 |
| Example 8 | 410 | 71 | 25 | 16.4 | 0.06 | 0.39 | 0.98 | 0.0039 | 0.0047 | 3.6 | 0.5 | 0.12 | 0.05 | 0.05 |
| Comperative Example 8 | 410 | 63 | 25 | 16.4 | 0.11 | 0.39 | 0.99 | 0.0039 | 0.0048 | 3.6 | 0.5 | 0.12 | 0.05 | 0.05 |
| Example 9 | 550 | 143 | 50 | 11.0 | 0.10 | 0.14 | 0.91 | 0.0025 | 0.0025 | 3.4 | 0.3 | 0.57 | 0.07 | 0.07 |
| Comperative Example 9 | 550 | 125 | 50 | 11.0 | 0.10 | 0.14 | 1.10 | 0.0025 | 0.0025 | 3.5 | 0.3 | 0.58 | 0.08 | 0.08 |
| Example 10 | 700 | 500 | 25 | 28.0 | 0.07 | 0.23 | 0.52 | 0.0055 | 0.0027 | 4.4 | 0.7 | 0.59 | 0.06 | 0.03 |
| Comperative Example 10 | 700 | 500 | 25 | 28.0 | 0.07 | 0.23 | 0.51 | 0.0057 | 0.0027 | 4.4 | 0.7 | 0.58 | 0.06 | 0.03 |
| Example 11 | 320 | 161 | 50 | 6.4 | 0.06 | 0.10 | 0.89 | 0.0079 | 0.0026 | 3.3 | 0.9 | 0.35 | 0.06 | 0.01 |
| Comperative Example 11 | 320 | 125 | 50 | 6.4 | 0.07 | 0.10 | 0.92 | 0.0082 | 0.0026 | 3.4 | 0.9 | 0.36 | 0.06 | 0.01 |
| Example 12 | 320 | 200 | 50 | 6.4 | 0.07 | 0.11 | 0.90 | 0.0083 | 0.0027 | 3.4 | 0.9 | 0.36 | 0.06 | 0.01 |
| Comperative Example 12 | 320 | 100 | 55 | 5.8 | 0.07 | 0.11 | 0.95 | 0.0082 | 0.0026 | 3.5 | 1.0 | 0.37 | 0.06 | 0.01 |
| Example 13 | 320 | 200 | 50 | 6.4 | 0.07 | 0.11 | 0.93 | 0.0084 | 0.0028 | 3.4 | 1.0 | 0.37 | 0.06 | 0.01 |
| Comperative Example 13 | 320 | 280 | 50 | 6.4 | 0.07 | 0.11 | 1.00 | 0.0082 | 0.0028 | 3.5 | 1.0 | 0.38 | 0.06 | 0.01 |

| | N | Others mass % | Ni Segregation Ratio | Vickers Hardness Number HV10 | Effective Diameter of Crystal Grain μm | Degree of Flatness of Prior Austenite Grain | First Hot Rolling Heating Temperature ° C. | First Hot Rolling Holding Time hr |
|---|---|---|---|---|---|---|---|---|
| Example 1 | 0.0066 | | 1.21 | 304 | 8.9 | 1.2 | 1283 | 42 |
| Comperative Example 1 | 0.0067 | | 1.32 | 306 | 8.3 | 1.2 | 1297 | 7 |
| Example 2 | 0.0011 | 0.4Cu | 1.15 | 303 | 3.4 | 1.6 | 1372 | 8 |
| Comperative Example 2 | 0.0011 | 0.4Cu | 1.33 | 308 | 3.4 | 1.4 | 1240 | 8 |
| Example 3 | 0.0058 | | 1.27 | 279 | 7.8 | 1.6 | 1267 | 10 |
| Comperative Example 3 | 0.0058 | | 1.35 | 284 | 7.2 | 1.6 | 1272 | 10 |
| Example 4 | 0.0033 | 0.012Ti | 1.08 | 304 | 2.3 | 2.7 | 1328 | 50 |
| Comperative Example 4 | 0.0034 | 0.012Ti | 1.08 | 308 | 2.3 | 2.7 | 1344 | 50 |
| Example 5 | 0.0010 | | 1.16 | 267 | 1.8 | 1.3 | 1292 | 20 |
| Comperative Example 5 | 0.0010 | | 1.17 | 252 | 1.6 | 1.3 | 1295 | 20 |
| Example 6 | 0.0042 | 0.008Nb | 1.07 | 279 | 5.9 | 2.7 | 1343 | 45 |
| Comperative Example 6 | 0.0043 | 0.008Nb | 1.09 | 282 | 6.0 | 3.2 | 1363 | 46 |
| Example 7 | 0.0004 | | 1.26 | 272 | 9.4 | 1.4 | 1265 | 10 |
| Comperative Example 7 | 0.0004 | | 1.27 | 274 | 11.0 | 1.3 | 1290 | 10 |
| Example 8 | 0.0020 | 0.015V 0.002REM | 1.15 | 267 | 6.1 | 1.2 | 1310 | 43 |
| Comperative Example 8 | 0.0020 | 0.015V 0.002REM | 1.15 | 318 | 7.3 | 1.2 | 1328 | 43 |
| Example 9 | 0.0044 | | 1.14 | 279 | 9.6 | 1.1 | 1373 | 48 |
| Comperative | 0.0044 | | 1.14 | 305 | 8.1 | 1.1 | 1375 | 48 |

TABLE 2-continued

| | | | | | | | |
|---|---|---|---|---|---|---|---|
| Example 9 | | | | | | | |
| Example 10 | 0.0014 | 1.25 | 310 | 7.5 | 1.5 | 1264 | 12 |
| Comperative Example 10 | 0.0014 | 1.41 | 310 | 7.3 | 1.3 | 1282 | 12 |
| Example 11 | 0.0019 | 1.12 | 271 | 6.2 | 1.3 | 1270 | 30 |
| Comperative Example 11 | 0.0019 | 1.12 | 276 | 11.5 | 1.3 | 1289 | 30 |
| Example 12 | 0.0019 | 1.29 | 280 | 9.6 | 1.8 | 1292 | 10 |
| Comperative Example 12 | 0.0020 | 1.29 | 290 | 10.5 | 1.9 | 1298 | 10 |
| Example 13 | 0.0019 | 1.29 | 290 | 9.6 | 1.8 | 1291 | 10 |
| Comperative Example 13 | 0.0021 | 1.32 | 302 | 9.6 | 1.9 | 1291 | 10 |

| | First Hot Rolling | | Second Hot Rolling | | | | |
|---|---|---|---|---|---|---|---|
| | Reduction Ratio | Temperature Before Final Rolling Pass ° C. | Heating Temperature ° C. | Reduction Ratio | Temperature Before Final Rolling Pass ° C. | Time from Completion of Rolling to Start of Water cooling s | Temperature at Completing of Water Cooling ° C. |
| Example 1 | 8.3 | 1249 | 1130 | 2.5 | 839 | 49 | 142 |
| Comperative Example 1 | 8.3 | 1245 | 1140 | 2.5 | 840 | 49 | 143 |
| Example 2 | 5.3 | 1057 | 1077 | 2.5 | 730 | 71 | 116 |
| Comperative Example 2 | 5.3 | 1077 | 1087 | 2.5 | 736 | 71 | 116 |
| Example 3 | 1.6 | 853 | 1125 | 5.0 | 765 | 77 | 194 |
| Comperative Example 3 | 1.1 | 869 | 1138 | 7.6 | 768 | 78 | 195 |
| Example 4 | 4.6 | 955 | 1069 | 10.0 | 796 | 61 | 191 |
| Comperative Example 4 | 4.6 | 955 | 1069 | 10.0 | 798 | 62 | 191 |
| Example 5 | 2.3 | 1027 | 1100 | 12.0 | 785 | 24 | 120 |
| Comperative Example 5 | 2.3 | 1027 | 1100 | 12.0 | 765 | 24 | 121 |
| Example 6 | 2.9 | 999 | 1037 | 2.2 | 689 | 61 | 63 |
| Comperative Example 6 | 2.6 | 1002 | 1042 | 2.5 | 670 | 61 | 64 |
| Example 7 | 9.6 | 1186 | 1260 | 2.9 | 985 | 93 | 33 |
| Comperative Example 7 | 9.7 | 1197 | 1260 | 2.8 | 1005 | 95 | 33 |
| Example 8 | 5.7 | 1199 | 1183 | 2.9 | 845 | 41 | 123 |
| Comperative Example 8 | 6.6 | 1204 | 1197 | 2.5 | 849 | 42 | 124 |
| Example 9 | 3.9 | 801 | 916 | 2.9 | 889 | 84 | 117 |
| Comperative Example 9 | 4.4 | 806 | 940 | 2.5 | 896 | 85 | 118 |
| Example 10 | 1.4 | 984 | 1228 | 20.0 | 805 | 34 | 190 |
| Comperative Example 10 | 1.4 | 780 | 1240 | 20.0 | 819 | 35 | 190 |
| Example 11 | 2.0 | 1147 | 1248 | 3.2 | 957 | 48 | 55 |
| Comperative Example 11 | 2.6 | 1142 | 1300 | 2.5 | 962 | 49 | 56 |
| Example 12 | 1.6 | 1180 | 1160 | 4.0 | 985 | 68 | 150 |
| Comperative Example 12 | 3.2 | 1185 | 1197 | 1.8 | 988 | 68 | 150 |
| Example 13 | 1.6 | 1192 | 1184 | 4.0 | 988 | 68 | 153 |
| Comperative Example 13 | 1.1 | 1185 | 1179 | 5.6 | 987 | 69 | 150 |

TABLE 3

| | Casting Slab Thickness mm | Middlepoint Slab Thickness mm | Final Thickness mm | Total Reduction Ratio | C | Si | Mn | P | S mass % | Ni | Cr | Mo | V | Al |
|---|---|---|---|---|---|---|---|---|---|---|---|---|---|---|
| Example 14 | 320 | 200 | 50 | 6.4 | 0.07 | 0.11 | 0.95 | 0.0088 | 0.0029 | 3.5 | 1.0 | 0.37 | 0.06 | 0.01 |
| Comparative Example 14 | 270 | 200 | 50 | 5.4 | 0.07 | 0.11 | 1.03 | 0.0083 | 0.0028 | 3.5 | 1.0 | 0.40 | 0.06 | 0.01 |
| Example 15 | 320 | 200 | 50 | 6.4 | 0.07 | 0.11 | 0.98 | 0.0089 | 0.0029 | 3.5 | 1.0 | 0.37 | 0.06 | 0.01 |
| Comparative | 270 | 90 | 50 | 5.4 | 0.07 | 0.12 | 1.05 | 0.0083 | 0.0029 | 3.6 | 1.0 | 0.40 | 0.06 | 0.01 |

TABLE 3-continued

| | | | | | | | | | | | | | | |
|---|---|---|---|---|---|---|---|---|---|---|---|---|---|---|
| Example 15 | | | | | | | | | | | | | | |
| Example 16 | 320 | 200 | 50 | 6.4 | 0.07 | 0.11 | 0.99 | 0.0093 | 0.0031 | 3.6 | 1.1 | 0.39 | 0.07 | 0.01 |
| Comparative Example 16 | 270 | 250 | 50 | 5.4 | 0.08 | 0.12 | 1.09 | 0.0087 | 0.0030 | 3.6 | 1.0 | 0.41 | 0.06 | 0.01 |
| Example 17 | 320 | 200 | 50 | 6.4 | 0.07 | 0.12 | 1.00 | 0.0095 | 0.0031 | 3.7 | 1.1 | 0.39 | 0.07 | 0.01 |
| Comparative Example 17 | 105 | 95 | 50 | 2.1 | 0.08 | 0.12 | 1.11 | 0.0088 | 0.0030 | 3.6 | 1.0 | 0.42 | 0.07 | 0.01 |
| Example 18 | 330 | 39 | 12 | 27.5 | 0.07 | 0.25 | 0.70 | 0.0021 | 0.0005 | 3.0 | 0.9 | 0.45 | 0.06 | 0.04 |
| Comparative Example 18 | 330 | 40 | 12 | 27.5 | 0.07 | 0.26 | 0.68 | 0.0019 | 0.0006 | 3.1 | 0.9 | 0.63 | 0.01 | 0.04 |
| Example 19 | 410 | 63 | 25 | 16.4 | 0.08 | 0.19 | 0.81 | 0.0013 | 0.0014 | 3.5 | 0.5 | 0.22 | 0.04 | 0.05 |
| Comparative Example 19 | 410 | 63 | 25 | 16.4 | 0.08 | 0.19 | 0.82 | 0.0013 | 0.0015 | 3.5 | 0.5 | 0.22 | 0.04 | 0.05 |
| Example 20 | 550 | 63 | 25 | 22.0 | 0.08 | 0.24 | 0.65 | 0.0066 | 0.0038 | 4.5 | 0.6 | 0.13 | 0.04 | 0.04 |
| Comparative Example 20 | 550 | 63 | 25 | 22.0 | 0.08 | 0.24 | 0.65 | 0.0068 | 0.0052 | 4.3 | 1.1 | 0.14 | 0.04 | 0.04 |
| Example 21 | 700 | 125 | 40 | 17.5 | 0.06 | 0.04 | 0.97 | 0.0038 | 0.0028 | 2.4 | 0.8 | 0.53 | 0.08 | 0.04 |
| Comparative Example 21 | 700 | 125 | 40 | 17.5 | 0.06 | 0.05 | 0.99 | 0.0039 | 0.0028 | 2.4 | 0.8 | 0.53 | 0.11 | 0.08 |
| Example 22 | 550 | 63 | 25 | 22.0 | 0.08 | 0.07 | 0.72 | 0.0042 | 0.0024 | 4.0 | 0.4 | 0.31 | 0.06 | 0.03 |
| Comparative Example 22 | 550 | 45 | 25 | 22.0 | 0.08 | 0.07 | 0.72 | 0.0043 | 0.0025 | 4.0 | 0.4 | 0.32 | 0.06 | 0.03 |
| Example 23 | 410 | 63 | 25 | 16.4 | 0.08 | 0.38 | 0.96 | 0.0030 | 0.0014 | 3.2 | 0.2 | 0.25 | 0.08 | 0.03 |
| Comparative Example 23 | 410 | 63 | 25 | 16.4 | 0.08 | 0.39 | 0.95 | 0.0030 | 0.0014 | 3.5 | 0.2 | 0.25 | 0.08 | 0.03 |
| Example 24 | 250 | 200 | 40 | 6.3 | 0.07 | 0.07 | 0.74 | 0.0034 | 0.0018 | 3.5 | 0.9 | 0.34 | 0.09 | 0.07 |
| Comparative Example 24 | 210 | 150 | 40 | 5.3 | 0.07 | 0.07 | 0.74 | 0.0035 | 0.0018 | 3.6 | 0.9 | 0.34 | 0.09 | 0.07 |
| Example 25 | 250 | 200 | 40 | 6.3 | 0.07 | 0.07 | 0.75 | 0.0034 | 0.0019 | 3.59 | 0.91 | 0.34 | 0.09 | 0.07 |
| Comparative Example 25 | 250 | 200 | 40 | 6.3 | 0.07 | 0.07 | 0.74 | 0.0035 | 0.0019 | 3.64 | 0.94 | 0.35 | 0.09 | 0.07 |
| Example 26 | 250 | 200 | 40 | 6.3 | 0.07 | 0.07 | 0.77 | 0.0035 | 0.0019 | 3.61 | 0.92 | 0.34 | 0.10 | 0.07 |
| Comparative Example 26 | 250 | 200 | 40 | 6.3 | 0.07 | 0.07 | 0.74 | 0.0036 | 0.0019 | 3.72 | 0.96 | 0.36 | 0.10 | 0.07 |

| | N | Others | Ni Segregation Ratio | Vickers Hardness Number HV10 | Effective Diameter of Crystal Grain μm | Degree of Flatness of Prior Austenite Grain | First Hot Rolling | |
|---|---|---|---|---|---|---|---|---|
| | mass % | | | | | | Heating Temperature ° C. | Holding Time hr |
| Example 14 | 0.0020 | | 1.28 | 295 | 9.6 | 1.8 | 1290 | 10 |
| Comparative Example 14 | 0.0021 | | 1.28 | 321 | 9.6 | 1.9 | 1295 | 10 |
| Example 15 | 0.0021 | | 1.28 | 307 | 9.6 | 1.8 | 1294 | 10 |
| Comparative Example 15 | 0.0022 | | 1.28 | 321 | 10.5 | 1.9 | 1296 | 10 |
| Example 16 | 0.0021 | | 1.25 | 317 | 9.7 | 1.8 | 1295 | 10 |
| Comparative Example 16 | 0.0023 | | 1.32 | 334 | 9.7 | 1.8 | 1294 | 10 |
| Example 17 | 0.0021 | | 1.26 | 327 | 9.7 | 1.8 | 1294 | 10 |
| Comparative Example 17 | 0.0024 | | 1.33 | 344 | 10.8 | 1.9 | 1293 | 10 |
| Example 18 | 0.0040 | | 1.15 | 309 | 6.9 | 1.4 | 1347 | 30 |
| Comparative Example 18 | 0.0042 | | 1.15 | 308 | 9.2 | 1.3 | 1347 | 30 |
| Example 19 | 0.0040 | 0.001B | 1.16 | 271 | 9.4 | 1.3 | 1341 | 43 |
| Comparative Example 19 | 0.0041 | 0.001B | 1.33 | 272 | 6.5 | 1.3 | 1364 | 44 |
| Example 20 | 0.0063 | | 1.17 | 268 | 7.9 | 1.2 | 1349 | 33 |
| Comparative Example 20 | 0.0063 | 0.0023Ca | 1.17 | 293 | 9.2 | 1.2 | 1357 | 33 |
| Example 21 | 0.0019 | 0.0021Ca | 1.19 | 270 | 8.0 | 1.2 | 1265 | 28 |
| Comparative Example 21 | 0.0019 | | 1.19 | 286 | 8.7 | 1.2 | 1288 | 28 |
| Example 22 | 0.0054 | | 1.16 | 267 | 7.3 | 1.4 | 1353 | 26 |
| Comparative Example 22 | 0.0054 | 0.015Nb | 1.15 | 270 | 12.5 | 1.6 | 1358 | 27 |
| Example 23 | 0.0029 | 0.015Nb | 1.06 | 267 | 6.5 | 1.3 | 1340 | 22 |
| Comparative Example 23 | 0.0075 | | 1.05 | 255 | 7.3 | 1.5 | 1342 | 22 |
| Example 24 | 0.0014 | | 1.23 | 275 | 5.9 | 1.4 | 1284 | 29 |
| Comparative Example 24 | 0.0014 | | 1.29 | 277 | 7.8 | 1.5 | 1305 | 30 |
| Example 25 | 0.0015 | | 1.24 | 278 | 6.1 | 1.4 | 1300 | 20 |
| Comparative Example 25 | 0.0014 | | 1.31 | 259 | 8.0 | 1.6 | 1335 | 20 |
| Example 26 | 0.0015 | | 1.25 | 284 | 6.1 | 1.4 | 1330 | 20 |
| Comparative | 0.0015 | | 1.35 | 256 | 8.1 | 1.6 | 1371 | 20 |

TABLE 3-continued

Example 26

| | First Hot Rolling | | Second Hot Rolling | | | | |
|---|---|---|---|---|---|---|---|
| | Reduction Ratio | Temperature Before Final Rolling Pass ° C. | Heating Temperature ° C. | Reduction Ratio | Temperature Before Final Rolling Pass ° C. | Time from Completion of Rolling to Start of Water cooling s | Temperature at Completing of Water Cooling ° C. |
| Example 14 | 1.6 | 1207 | 1184 | 4.0 | 992 | 68 | 150 |
| Comparative Example 14 | 1.4 | 1184 | 1164 | 4.0 | 994 | 68 | 152 |
| Example 15 | 1.6 | 1182 | 1167 | 4.0 | 985 | 68 | 153 |
| Comparative Example 15 | 3.0 | 1205 | 1187 | 1.8 | 984 | 69 | 150 |
| Example 16 | 1.6 | 1212 | 1170 | 4.0 | 999 | 68 | 153 |
| Comparative Example 16 | 1.1 | 1187 | 1177 | 5.0 | 985 | 69 | 152 |
| Example 17 | 1.6 | 1188 | 1183 | 4.0 | 985 | 68 | 151 |
| Comparative Example 17 | 1.11 | 1207 | 1187 | 1.9 | 990 | 69 | 153 |
| Example 18 | 8.5 | 913 | 1050 | 3.2 | 911 | 45 | 75 |
| Comparative Example 18 | 8.3 | 919 | 1045 | 3.3 | 905 | 48 | 75 |
| Example 19 | 6.6 | 938 | 1128 | 2.5 | 995 | 57 | 106 |
| Comparative Example 19 | 6.6 | 1260 | 1151 | 2.5 | 985 | 58 | 108 |
| Example 20 | 8.8 | 1203 | 912 | 2.5 | 898 | 67 | 51 |
| Comparative Example 20 | 8.8 | 1210 | 937 | 2.5 | 914 | 68 | 51 |
| Example 21 | 5.6 | 1141 | 995 | 3.1 | 915 | 35 | 33 |
| Comparative Example 21 | 5.6 | 1148 | 1017 | 3.1 | 919 | 35 | 33 |
| Example 22 | 8.8 | 874 | 1189 | 2.5 | 719 | 64 | 96 |
| Comparative Example 22 | 12.2 | 887 | 1221 | 1.8 | 730 | 66 | 96 |
| Example 23 | 6.5 | 1125 | 1100 | 2.5 | 963 | 62 | 158 |
| Comparative Example 23 | 6.6 | 1126 | 1100 | 2.5 | 962 | 105 | 159 |
| Example 24 | 1.3 | 1054 | 1207 | 5.0 | 737 | 94 | 48 |
| Comparative Example 24 | 1.4 | 1063 | 1212 | 3.8 | 743 | 96 | 48 |
| Example 25 | 1.3 | 1052 | 1205 | 5.0 | 750 | 74 | 102 |
| Comparative Example 25 | 1.3 | 1050 | 1210 | 5.0 | 755 | 110 | 105 |
| Example 26 | 1.3 | 1050 | 1215 | 5.0 | 758 | 72 | 108 |
| Comparative Example 26 | 1.3 | 1049 | 1212 | 5.0 | 760 | 75 | 225 |

Evaluation results of properties are shown in Table 4. Note that the tempering is performed at temperatures ranging from 630° C. to 680° C.

TABLE 4

| | Yield Stress (C Direction) | Tensile Strength (C Direction) | Strength Anisotropy | | Base Material Toughness | | Welded Joint Charpy impact | |
|---|---|---|---|---|---|---|---|---|
| | MPa | MPa | MPa | Evaluation | J | Evaluation | J | Evaluation |
| Example 1 | 959 | 964 | 5 | OK | 190 | OK | 128 | OK |
| Comparative Example 1 | 967 | 971 | 8 | OK | 195 | OK | 96 | NG |
| Example 2 | 948 | 961 | 20 | OK | 202 | OK | 187 | OK |
| Comparative Example 2 | 965 | 976 | 21 | OK | 219 | OK | 90 | NG |
| Example 3 | 850 | 883 | 10 | OK | 190 | OK | 129 | OK |
| Comparative Example 3 | 870 | 899 | 8 | OK | 182 | OK | 86 | NG |
| Example 4 | 960 | 964 | 45 | OK | 266 | OK | 212 | OK |
| Comparative Example 4 | 972 | 975 | 43 | OK | 78 | NG | 25 | NG |
| Example 5 | 813 | 845 | 24 | OK | 252 | OK | 151 | OK |
| Comparative Example 5 | 760 | 800 | 29 | OK | 148 | NG | 78 | NG |
| Example 6 | 850 | 883 | 45 | OK | 218 | OK | 223 | OK |
| Comparative Example 6 | 863 | 894 | 53 | NG | 207 | OK | 225 | OK |
| Example 7 | 845 | 862 | 24 | OK | 160 | OK | 107 | OK |
| Comparative Example 7 | 853 | 869 | 20 | OK | 145 | NG | 120 | OK |

TABLE 4-continued

| | Yield Stress (C Direction) | Tensile Strength (C Direction) | Strength Anisotropy | | Base Material Toughness | | Welded Joint Charpy impact | |
|---|---|---|---|---|---|---|---|---|
| | MPa | MPa | MPa | Evaluation | J | Evaluation | J | Evaluation |
| Example 8 | 813 | 846 | 8 | OK | 197 | OK | 194 | OK |
| Comparative Example 8 | 902 | 921 | 9 | OK | 133 | NG | 88 | NG |
| Example 9 | 853 | 886 | 9 | OK | 195 | OK | 176 | OK |
| Comparative Example 9 | 955 | 968 | 9 | OK | 143 | NG | 126 | OK |
| Example 10 | 973 | 982 | 13 | OK | 191 | OK | 145 | OK |
| Comparative Example 10 | 974 | 983 | 20 | OK | 183 | OK | 89 | NG |
| Example 11 | 820 | 859 | 25 | OK | 191 | OK | 164 | OK |
| Comparative Example 11 | 839 | 874 | 26 | OK | 135 | NG | 125 | OK |
| Example 12 | 853 | 886 | 23 | OK | 152 | OK | 108 | OK |
| Comparative Example 12 | 895 | 920 | 23 | OK | 138 | NG | 108 | OK |
| Example 13 | 893 | 918 | 24 | OK | 155 | OK | 108 | OK |
| Comparative Example 13 | 940 | 956 | 25 | OK | 157 | OK | 92 | NG |
| Example 14 | 914 | 935 | 25 | OK | 157 | OK | 110 | OK |
| Comparative Example 14 | 979 | 987 | 26 | OK | 136 | NG | 110 | OK |
| Example 15 | 961 | 973 | 26 | OK | 162 | OK | 109 | OK |
| Comparative Example 15 | 1018 | 1019 | 26 | OK | 62 | NG | 110 | OK |
| Example 16 | 1003 | 1006 | 27 | OK | 164 | OK | 108 | OK |
| Comparative Example 16 | 1070 | 1060 | 27 | OK | 145 | NG | 90 | NG |
| Example 17 | 1039 | 1036 | 27 | OK | 167 | OK | 110 | OK |
| Comparative Example 17 | 1106 | 1089 | 28 | OK | 78 | NG | 45 | NG |
| Example 18 | 903 | 943 | 23 | OK | 211 | OK | 165 | OK |
| Comparative Example 18 | 905 | 940 | 18 | OK | 208 | OK | 89 | NG |
| Example 19 | 831 | 860 | 14 | OK | 182 | OK | 125 | OK |
| Comparative Example 19 | 834 | 863 | 27 | OK | 186 | OK | 78 | NG |
| Example 20 | 818 | 849 | 6 | OK | 186 | OK | 165 | OK |
| Comparative Example 20 | 911 | 929 | 7 | OK | 101 | NG | 45 | NG |
| Example 21 | 816 | 856 | 8 | OK | 191 | OK | 151 | OK |
| Comparative Example 21 | 880 | 908 | 8 | OK | 78 | NG | 29 | NG |
| Example 22 | 815 | 847 | 16 | OK | 198 | OK | 154 | OK |
| Comparative Example 22 | 826 | 856 | 15 | OK | 120 | NG | 103 | OK |
| Example 23 | 815 | 847 | 11 | OK | 182 | OK | 235 | OK |
| Comparative Example 23 | 831 | 861 | 14 | OK | 43 | NG | 25 | NG |
| Example 24 | 834 | 871 | 10 | OK | 216 | OK | 130 | OK |
| Comparative Example 24 | 845 | 879 | 15 | OK | 145 | NG | 102 | OK |
| Example 25 | 849 | 883 | 22 | OK | 152 | OK | 108 | OK |
| Comparative Example 25 | 802 | 822 | 21 | OK | 147 | NG | 110 | OK |
| Example 26 | 869 | 899 | 13 | OK | 153 | OK | 112 | OK |
| Comparative Example 26 | 798 | 811 | 15 | OK | 145 | NG | 115 | OK |

The yield stress and the tensile strength were measured in accordance with a method of tensile test for metallic materials set forth in JIS Z 2241. Test pieces were prepared in accordance with Test pieces for tensile test for metallic materials set forth in JIS Z 2201. From the steel plates having a plate thickness of 20 mm or lower, No. 5 test pieces were taken. From the steel plates having a plate thickness of 40 mm or more, No. 10 test pieces were taken at the one-fourth t portion below surface of each of the steel plates. Each of the test pieces was cut out such that a longitudinal direction of the test piece is parallel to or perpendicular to the rolling direction. The direction parallel to the rolling direction refers to an L direction, and the direction perpendicular to the rolling direction refers to a C direction. The yield stress was based on 0.2% proof stress calculated by an offset method. Two test pieces were tested at ordinary temperatures, and an average value thereof was adopted. The strength anisotropy was evaluated on the basis of a difference between the yield stress in the C direction and that in the L direction, and OK was applied when the difference was 50 MPa or lower, while NG was applied when the difference exceeded 50 MPa.

As for the toughness of the base material, the Charpy impact absorbing energy is measured in accordance with a method of impact test of metallic materials set forth in JIS Z 2242. Test pieces were prepared in accordance with Test pieces for impact test for metallic materials set forth in JIS Z 2202, which were cut out at the one-fourth t portion. A width of each of the test pieces was 10 mm. A width of 5 mm of test piece was cut out from a steel plate having a thickness of 6 mm. Each of the test pieces was formed into a V-notch shape, and was cut out such that a line formed by a notch bottom is parallel to a plate thickness direction, and a longitudinal direction of test piece is perpendicular to the rolling direction. Test was performed at a temperature of −70° C. Three test pieces were tested, and an average value thereof was adopted. A necessary value of the Charpy impact absorbing energy was set at 150 J or more, which is a condition generally employed in a marine structure. OK was applied when the value of the Charpy impact absorbing energy was 150 J or more, and NG was applied when the value was less than 150 J.

The toughness of the weld heat-affected zone was evaluated by using Charpy test pieces cut out from welded joints prepared through SMAW. SMAW was performed under conditions of input heat of 1.5-2.0 kJ/cm, and preheat temperature and pass-to-pass temperature of 100° C. or lower. A notch portion of each of the Charpy test piece was made corresponded to a bonding portion. Test was performed at a temperature of −70° C. Three test pieces were tested, and an average value thereof was adopted. In the Charpy test of the welded joint, OK was applied when the value was 100 J or more, and NG was applied when the value was less than 100 J.

In Example 1, a steel plate having a plate thickness of 12 mm was manufactured by controlling a band-like Ni segregation ratio. This steel plate had an excellent toughness in the base material and in the weld heat-affected zone, and had a small strength anisotropy. On the other hand, in Comparative Example 1 in which a steel plate was manufactured with components and by a manufacturing method similar to those of Example 1, the holding time at the first hot rolling and the Ni segregation ratio were outside the range specified in the present invention. Therefore, the steel plate in Comparative Example 1 had an inferior toughness in the weld heat-affected zone.

In Example 2, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 2 in which a steel plate was manufactured with components and by a manufacturing method similar to those of Example 2, the heating temperature at the first hot rolling and the segregation ratio were outside the range specified in the present invention. Therefore, the steel plate in Comparative Example 2 had an inferior toughness in the weld heat-affected zone.

In Example 3, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 3 in which a steel plate was manufactured with components and by a manufacturing method similar to those of Example 3, the reduction ratio at the first hot rolling and the segregation ratio were outside the range specified in the present invention. Therefore, the steel plate in Comparative Example 3 had an inferior toughness in the weld heat-affected zone.

In Example 4, a steel plate having a plate thickness of 12 mm was manufactured by controlling a band-like Ni segregation ratio. This steel plate had an excellent toughness in the base material and in the weld heat-affected zone, and had a small strength anisotropy. On the other hand, in Comparative Example 4 in which a steel plate was manufactured with components and by a manufacturing method similar to those of Example 4, the amount of Si and the amount of P were outside the range specified in the present invention. Therefore, the steel plate in Comparative Example 4 had an inferior toughness in the base material and in the weld heat-affected zone.

In Example 5, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 5 in which a steel plate was manufactured with components and by a manufacturing method similar to those of Example 5, the amount of Ni was outside the range specified in the present invention. Therefore, the steel plate in Comparative Example 5 had an inferior toughness in the base material and in the weld heat-affected zone.

In Example 6, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 6 in which a steel plate was manufactured with components and by a manufacturing method similar to those of Example 6, the temperature before the final rolling pass of the second hot rolling and the degree of flatness of the prior austenite grain were outside the range specified in the present invention. Therefore, the steel plate in Comparative Example 6 had a larger strength anisotropy.

In Example 7, a steel plate having a plate thickness of 12 mm was manufactured by controlling a band-like Ni segregation ratio. This steel plate had an excellent toughness in the base material and in the weld heat-affected zone, and had a small strength anisotropy. On the other hand, in Comparative Example 7 in which a steel plate was manufactured with components and by a manufacturing method similar to those of Example 7, the temperature before the final rolling pass of the second hot rolling and the effective diameter of crystal grain were outside the range specified in the present invention. Therefore, the steel plate in Comparative Example 7 had an inferior toughness in the base material.

In Example 8, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 8 in which a steel plate was manufactured with components and by a manufacturing method similar to those of Example 8, the amount of C and the Vickers hardness number were outside the range specified in the present invention. Therefore, the steel plate in Comparative Example 8 had an inferior toughness in the base material and in the weld heat-affected zone.

In Example 9, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 9 in which a steel plate was manufactured with components and by a manufacturing method similar to those of Example 9, the amount of Mn was outside the range specified in the present invention. Therefore, the steel plate in Comparative Example 9 had an inferior toughness in the base material.

In Example 10, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 10 in which a steel plate was manufactured with components and by a manufacturing method similar to those of Example 10, the temperature before the final rolling pass of the first hot rolling and the segregation ratio were outside the range specified in the present invention. Therefore, the steel plate in Comparative Example 10 had an inferior toughness in the weld heat-affected zone.

In Example 11, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 11 in which a steel plate was manufactured with components and by a manufacturing method similar to those of Example 11, the heating temperature at the time of the second hot rolling and the effective diameter of crystal grain were outside the range specified in the present invention. Therefore, the steel plate in Comparative Example 11 had an inferior toughness in the base material.

In Example 12, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 12 in which a steel plate was manufactured with components and by a manufacturing method similar to those of Example 12, the reduction ratio of the second hot rolling and the effective diameter of crystal grain were outside the range specified in the present invention. Therefore, the steel plate in Comparative Example 12 had an inferior toughness in the base material.

In Example 13, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 13 in which a steel plate was manufactured with components and by a manufacturing method similar to those of Example 13, the reduction ratio of the first hot rolling and the Ni segregation ratio were outside the range specified in the present invention. Therefore, the steel plate in Comparative Example 13 had an inferior toughness in the weld heat-affected zone.

In Example 14, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 14 in which a steel plate was manufactured with components and by a manufacturing method similar to those of Example 14, the total reduction ratio was outside the range specified in the present invention. Therefore, the steel plate in Comparative Example 14 had an inferior toughness in the base material.

In Example 15, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 15 in which a steel plate was manufactured with components and by a manufacturing method similar to those of Example 15, the total reduction ratio, the reduction ratio of the second hot rolling and the effective diameter of crystal grain were outside the range specified in the present invention. Therefore, the steel plate in Comparative Example 15 had a significantly inferior toughness in the base material.

In Example 16, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 16 in which a steel plate was manufactured with components and by a manufacturing method similar to those of Example 16, the total reduction ratio, the reduction ratio of the first hot rolling and the Ni segregation ratio were outside the range specified in the present invention. Therefore, the steel plate in Comparative Example 16 had an inferior toughness in the base material and in the weld heat-affected zone.

In Example 17, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 17 in which a steel plate was manufactured with components and by a manufacturing method similar to those of Example 17, the total reduction ratio, the reduction ratio of the first hot rolling, the reduction ratio of the second hot rolling, the Ni segregation ratio, and the effective diameter of crystal grain were outside the range specified in the present invention. Therefore, the steel plate in Comparative Example 17 had an inferior toughness in the base material and in the weld heat-affected zone.

In Example 18, a steel plate having a plate thickness of 12 mm was manufactured by controlling a band-like Ni segregation ratio. This steel plate had an excellent toughness in the base material and in the weld heat-affected zone, and had a small strength anisotropy. On the other hand, in Comparative Example 18 in which a steel plate was manufactured with components and by a manufacturing method similar to those of Example 18, the amount of Mo was outside the range specified in the present invention. Therefore, the steel plate in Comparative Example 18 had an inferior toughness in the weld heat-affected zone.

In Example 19, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 19 in which a steel plate was manufactured with components and by a manufacturing method similar to those of Example 19, the temperature before the final rolling pass of the first hot rolling and the Ni segregation ratio were outside the range specified in the present invention. Therefore, the steel plate in Comparative Example 19 had an inferior toughness in the weld heat-affected zone.

In Example 20, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 20 in which a steel plate was manufactured with components and by a manufacturing method similar to those of Example 20, the amount of S and the amount of Cr were outside the range specified in the present invention. Therefore, the steel plate in Comparative Example 20 had an inferior toughness in the base material and in the weld heat-affected zone.

In Example 21, a steel plate having a plate thickness of 50 mm was manufactured by controlling a band-like Ni segregation ratio. This steel plate had an excellent toughness in the base material and in the weld heat-affected zone, and had a small strength anisotropy. On the other hand, in Comparative Example 21 in which a steel plate was manufactured with components and by a manufacturing method similar to those of Example 21, the amount of V and the amount of Al were outside the range specified in the present invention. Therefore, the steel plate in Comparative Example 21 had an inferior toughness in the base material and in the weld heat-affected zone.

In Example 22, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 22 in which a steel plate was manufactured with components and by a manufacturing method similar to those of Example 22, the reduction ratio of the second hot rolling and the effective diameter of crystal grain were outside the range specified in the present invention. Therefore, the steel plate in Comparative Example 22 had an inferior toughness in the base material.

In Example 23, a steel plate having a plate thickness of 25 mm was manufactured by controlling a band-like Ni segregation ratio. This steel plate had an excellent toughness in the base material and in the weld heat-affected zone, and had a small strength anisotropy. On the other hand, in Comparative Example 23 in which a steel plate was manufactured with components and by a manufacturing method similar to those of Example 23, the amount of N, the Vickers hardness number, and the time from completion of rolling to start of water cooling at the time of the second hot rolling were outside the range specified in the present invention. Therefore, the steel plate in Comparative Example 23 had an inferior toughness in the base material.

In Example 24, a steel plate having a plate thickness of 40 mm was manufactured by controlling a band-like Ni segregation ratio. This steel plate had an excellent toughness in the base material and in the weld heat-affected zone. On the other hand, in Comparative Example 24 in which a steel plate was manufactured with components and by a manufacturing method similar to those of Example 24, the total reduction ratio was outside the range specified in the present invention. Therefore, the steel plate in Comparative Example 24 had an inferior toughness in the base material.

In Example 25, a steel plate having a plate thickness of 40 mm was manufactured by controlling a band-like Ni segregation ratio. This steel plate had an excellent toughness in the base material and in the weld heat-affected zone. On the other hand, in Comparative Example 25 in which a steel plate was manufactured with components and by a manufacturing method similar to those of Example 25, the time from completion of rolling to start of water cooling at the time of the second hot rolling, and the Vickers hardness number were outside the range specified in the present invention. Therefore, the steel plate in Comparative Example 25 had an inferior toughness in the base material.

In Example 26, a steel plate having a plate thickness of 40 mm was manufactured by controlling a band-like Ni segregation ratio. This steel plate had an excellent toughness in the base material and in the weld heat-affected zone. On the other hand, in Comparative Example 26 in which a steel plate was manufactured with components and by a manufacturing method similar to those of Example 26, the temperature after water cooling and the Vickers hardness number were outside the range specified in the present invention. Therefore, the steel plate in Comparative Example 26 had an inferior toughness in the base material.

From Examples described above, it is obvious that the steel plates of Examples 1-26, which are thick steel plates manufactured according to the present invention, have excellent toughness in the weld heat-affected zone, and have a small strength anisotropy.

INDUSTRIAL APPLICABILITY

According to the present invention, it is possible to use a steel plate that exhibits excellent low-temperature toughness in a base material and a weld heat-affected zone and has small strength anisotropy. More specifically, the present invention is an invention having an industrially high value because welding workability becomes preferable as a welding heat input increases, and a degree of flexibility in designing becomes great as a directional limitation at the time of using the steel plate less likely occurs.

The invention claimed is:

1. A steel plate that exhibits excellent low-temperature toughness in a base material and a weld heat-affected zone and has small strength anisotropy, wherein the steel plate includes, by mass,

C: 0.04%-0.10%;

Si: 0.02%-0.40%;

Mn: 0.5%-1.0%;

P: 0.0010%-0.0100%;

S: 0.0001%-0.0050%;

Ni: 2.0%-4.5%;

Cr: 0.1%-1.0%;

Mo: 0.1%-0.6%;

V: 0.005%-0.1%;

Al: 0.01%-0.08%; and

N: 0.0001%-0.0070%, with a balance including Fe and inevitable impurities, a Ni segregation ratio at a portion located at one-fourth of a thickness of the steel plate in a steel-plate thickness direction from a surface of the steel plate is 1.3 or lower, a degree of flatness of a prior austenite grain is in a range from 1.05 to 3.0, an effective diameter of crystal grain is 10 μm or lower, and a Vickers hardness number is in a range of 265 HV to 310 HV.

2. The steel plate that exhibits excellent low-temperature toughness in the base material and the weld heat-affected zone and has small strength anisotropy according to claim 1, wherein the steel plate further includes at least one or two components of, by mass, Nb: 0.005%-0.03%;

Ti: 0.005%-0.03%;

Cu: 0.01%-0.7%%;

B: 0.0002%-0.05%;

Ca: 0.0002%-0.0040%; and

REM: 0.0002%40.0040%, with a balance including Fe and inevitable impurities.

3. A manufacturing method of a steel plate that exhibits excellent low-temperature toughness in a base material and a weld heat-affected zone and has small strength anisotropy, the steel plate including, by mass,

C: 0.04%-0.10%;

Si: 0.02%-0.40%;

Mn: 0.5%-1.0%;

P: 0.0010%-0.0100%;

S: 0.0001%-0.0050%;

Ni: 2.0%-4.5%;

Cr: 0.1%-1.0%;

Mo: 0.1%-0.6%;

V: 0.005%-0.1%;

Al: 0.01%-0.08%; and

N: 0.0001%-0.0070%, with a balance including Fe and inevitable impurities, wherein the method includes:

heating a casting slab having a thickness 5.5 times to 50 times thicker than a final plate thickness, to a temperature ranging from 1250° C. to 1380° C., and maintaining the temperature for eight hours or more;

applying a first hot rolling to the casting slab at a reduction ratio of 1.2 to 10.0, and a temperature before a final rolling pass of 800° C. to 1250° C. to obtain a steel strip;

air-cooling the steel strip to 300° C. or lower, and then heating the steel strip to a temperature ranging from 900° C. to 1270° C.;

applying a second hot rolling to the steel strip at a reduction ratio of 2.0 to 40.0, and a temperature before a final rolling pass of 680° C. to 1000° C.;

starting water-cooling within 100 seconds after the second hot rolling, and cooling the steel strip to a surface temperature of 200° C. or lower; and, applying tempering to the steel strip at a temperature of 550° C. to 720° C.

4. The manufacturing method of the steel plate that exhibits excellent low-temperature toughness in the base material and the weld heat-affected zone and has small strength anisotropy according to claim 3, the steel plate further including at least one or two components of, by mass, Nb: 0.005%-0.03%;

Ti: 0.005%-0.03%;

Cu: 0.01%-0.7%%;

B: 0.0002%-0.05%;

Ca: 0.0002%-0.0040%; and

REM: 0.0002%-0.0040%, with a balance including Fe and inevitable impurities.

* * * * *